US006635397B2

(12) United States Patent
Okamura et al.

(10) Patent No.: US 6,635,397 B2
(45) Date of Patent: Oct. 21, 2003

(54) NEGATIVE-CHARGING ELECTROPHOTOGRAPHIC PHOTOSENSITIVE MEMBER

(75) Inventors: Ryuji Okamura, Shizuoka (JP); Junichiro Hashizume, Shizuoka (JP); Kazuto Hosoi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 5 days.

(21) Appl. No.: 10/127,593

(22) Filed: Apr. 23, 2002

(65) Prior Publication Data

US 2003/0104293 A1 Jun. 5, 2003

(30) Foreign Application Priority Data

| | | |
|---|---|---|
| Apr. 24, 2001 | (JP) | 2001-125948 |
| Apr. 24, 2001 | (JP) | 2001-125949 |
| Apr. 11, 2002 | (JP) | 2002-109394 |
| Apr. 11, 2002 | (JP) | 2001-109395 |

(51) Int. Cl.[7] ..... G03G 5/08; G03G 5/10; G03G 5/14

(52) U.S. Cl. ..... 430/65; 430/66; 430/57.4; 430/57.7

(58) Field of Search ..... 430/65, 66, 57.4, 430/57.7

(56) References Cited

U.S. PATENT DOCUMENTS

| | | | | |
|---|---|---|---|---|
| 5,464,721 A | | 11/1995 | Yagi et al. | 430/126 |
| 5,514,507 A | | 5/1996 | Yagi et al. | 430/57 |
| 5,556,729 A | | 9/1996 | Fukuda et al. | 430/65 |
| 5,624,776 A | * | 4/1997 | Takei et al. | 430/56 |
| 5,876,886 A | | 3/1999 | Hashizume et al. | 430/57 |
| 5,972,550 A | * | 10/1999 | Tamura et al. | 430/65 |
| 6,156,472 A | | 12/2000 | Segi et al. | 430/128 |

FOREIGN PATENT DOCUMENTS

| | | |
|---|---|---|
| JP | 57-115556 | 7/1982 |
| JP | 6-83090 | 3/1994 |
| JP | 6-242623 | 9/1994 |
| JP | 6-337532 | 12/1994 |
| JP | 11-194515 | 7/1999 |

* cited by examiner

*Primary Examiner*—John Goodrow
(74) *Attorney, Agent, or Firm*—Fitzpatrick, Cella, Harper & Scinto

(57) ABSTRACT

A negative-charging electrophotographic photosensitive member comprising an aluminum-based substrate and a silicate film and a light-receiving layer in this order. The silicate film has a layer thickness of 0.5 nm to 15 nm and comprises at least aluminum atoms, silicon atoms and oxygen atoms. The light-receiving layer has at least a lower-part charge injection blocking layer formed of a non-single crystal silicon film comprising at least silicon atoms, nitrogen atoms and oxygen atoms, not doped with any impurities, a photoconductive layer formed of a non-single crystal silicon film comprising at least silicon atoms, an upper-part charge injection blocking layer formed of a non-single crystal silicon film comprising at least silicon atoms, carbon atoms and atoms belonging to the Group 13 of the periodic table, and a surface protective layer formed of a non-single crystal silicon film comprising at least silicon atoms and containing carbon atoms.

24 Claims, 5 Drawing Sheets

NEGATIVE-CHARGING ELECTROPHOTOGRAPHIC PHOTOSENSITIVE MEMBER

BACKGROUND OF THE INVENTION

1. Field of the Invention

This invention relates to a negative-charging electrophotographic photosensitive member comprising an aluminum-based substrate and formed thereon a functional film having a sensitivity to electromagnetic waves such as light (which herein refers to light in a broad sense and indicates ultraviolet rays, visible rays, infrared rays, X-rays, γ-rays, etc.).

2. Related Background Art

In the field of image formation, photoconductive materials that form light-receiving layers of light-receiving members such as electrophotographic photosensitive members are required to have properties as follows: They are highly sensitive, have a high SN ratio [light current (Ip)/dark current (Id)], have absorption spectra suited to spectral characteristics of electromagnetic waves to be applied, have a high response to light, have the desired dark resistance and are harmless to human bodies when used. In particular, in the case of electrophotographic photosensitive members set in electrophotographic apparatus used as business machines in offices, the harmlessness in their use is important.

Photoconductive materials having good properties in these respects include amorphous silicon (hereinafter often "a-Si"), and have attracted notice as light-receiving layers of light-receiving members such as electrophotographic photosensitive members.

In the production of such light-receiving members, it is common to form photoconductive layers comprised of a-Si, by film forming processes such as vacuum deposition, sputtering, ion plating, heat-assisted CVD, light-assisted CVD and plasma-assisted CVD, which layers are formed on conductive supports while heating the supports at 50° C. to 350° C. In particular, their production by the plasma-assisted CVD is preferable and has been put into practical use; the plasma-assisted CVD being a process in which source gases are decomposed by high-frequency or microwave glow discharging to form amorphous silicon deposited films on the support.

For example, Japanese Patent Application Laid-open No. 57-115556 discloses a technique in which a surface barrier layer formed of a non-photoconductive amorphous material containing silicon atoms and carbon atoms is provided on a photoconductive layer formed of an amorphous material composed chiefly of silicon atoms, in order to achieve improvements in electrical, optical and photoconductive properties such as dark resistance, photosensitivity and response to light and service evironmental properties such as moisture resistance and also in stability with time, of a photoconductive member having a photoconductive layer constituted of an a-Si deposited film.

Japanese Patent Application Laid-open No. 6-83090 (corresponding to U.S. Pat. No. 5,464,721) also discloses a contact-charging, negative-charging electrophotographic photosensitive member provided on a photoconductive layer with a charge-trapping layer and a charge injection blocking layer which are formed of a doped a-Si, in order to perform sufficient charging even at the time of high humidity.

Japanese Patent Application Laid-open No. 6-242623 (corresponding to U.S. Pat. No. 5,556,729) still also discloses a technique in which a hole-capturing layer composed chiefly of amorphous silicon and also containing less than 50 ppm of boron or not containing any element which governs the conductivity is provided between a photoconductive layer and a surface layer, of a negative-charging electrophotographic photosensitive member to achieve superior electrophotographic performance.

Japanese Patent Application Laid-open No. 6-337532 (corresponding to U.S. Pat. No. 5,514,507) still also discloses a negative-charging electrophotographic photosensitive member having a photoconductive layer consisting of two layers, a layer composed chiefly of amorphous silicon and a layer composed chiefly of amorphous silicon germanium, in order to achieve a higher photosensitivity in a long-wavelength region and an improvement in stability in repeating copying operation.

In addition, Japanese Patent Application Laid-open No. 11-194515 (corresponding to U.S. Pat. No. 6,156,472) still also discloses a technique in which a silicate film is formed between a conductive substrate and a functional film to obtain an electrophotographic photosensitive member which can provide uniform and high-grade images.

The above techniques have brought about improvement in electrical, optical and photoconductive characteristics and service environmental properties, and, with such improvements, have brought about an improvement in image quality.

In recent years, with spread of computers and advance of networks in offices, electrophotographic apparatus are not only used as conventional analog copying machines but also now sought to be made digital so that they can play a role as facsimile machines or printers. Moreover, digital full-color copying machines for full-color reproducing digitized information are demanded.

If conventional positive-charging electrophotographic photosensitive members are mounted to digital full-color copying machines so as to meet such demands, the following problems are worried about.

First, as toners for color copying machines, used in the digital full-color copying machines, negatively chargeable toners are commonly used, where the formation of latent images which is performed in combination of such negatively chargeable toners with the positive-charging electrophotographic photosensitive members is made by a background exposure method in which non-image areas (background area) are exposed. Hence, this may make it difficult to achieve high image quality.

Second, in the digital full-color copying machines, it is chiefly intended to form images of full-page photographs, as being different from black and white copying machines which chiefly form images of letters or characters only. Hence, any minute unevenness in potential of photosensitive members may susceptibly affect the image quality, and this may make it difficult to control such unevenness.

For example, photo-memory as typified by ghost can be one of the causes of such unevenness. In conventional positive-charging electrophotographic photosensitive members, it is difficult in some cases to make the photo-memory less occur to a level required in full-color copying machines. Accordingly, it has been earnestly sought to provide an electrophotographic photosensitive member which can achieve ghostless images. However, in the conventional positive-charging electrophotographic photosensitive members, it requires a great effort to make the photo-memory much less occur. In conventional negative-charging electrophotographic photosensitive member, too, under the existing conditions, there is room for improvement on how the photo-memory can be made to much less occur.

Moreover, in the digital full-color copying machines, a plurality of developing assemblies are provided around an electrophotographic photosensitive member in some cases as one of process conditions, and, because of the use of a large-size developing means, a charging assembly and developing assemblies tend to be distant from one another in construction. This makes it necessary for the positive-charging electrophotographic photosensitive members of course and also the negative-charging electrophotographic photosensitive members to be electrostatically charged at a higher potential than ever to compensate the potential lowering at the distance from the charging assembly to the developing assemblies, and also, as to their photosensitivity, makes it necessary for them to have a higher sensitivity.

In order to materialize chargeability which is high enough to be adaptable to the digital full-color copying process, such chargeability can be materialized to a certain extent by forming the photoconductive layer in a large thickness. This, however, may make defects or imperfections occur in a high probability during the formation of deposited films to cause faulty images. There have been problems in respect of technique and also in respect of cost, bringing about a difficult situation.

The formation of latent images in digital copying machines is also the formation of latent images in the form of "dots". Hence, even smeared images at a level not coming into question in conventional analog copying machines may appear as coarse images in, e.g., halftone images. Thus, with regard to the smeared images, it is indispensable for them to be made to much less occur than those in the analog copying machines.

More specifically, in conventional photosensitive members, when the amount of exposure is enlarged so that an image with a strong contrast can be obtained from a color-background original, photo-carriers are produced in a large quantity because of application of intense exposure to cause a phenomenon that the photo-carriers gather to and flow into the part to which they can readily move. Because of this phenomenon, it is becoming more necessary than ever to take a countermeasure for smeared images in intense exposure, what is called smeared EV, which causes blurred letters or characters.

In addition, when the photosensitive member is negatively charged by the corona charging method, which prevails in charging methods in the conventional digital copying machines, ozone products are produced in a larger quantity than those in positive charging, and hence the smeared images may occur. Accordingly, the chargeability must be more improved than ever to keep ozone from being produced.

SUMMARY OF THE INVENTION

Taking account of the circumstances stated above, an object of the present invention is to provide, in a-Si photosensitive members, which have good stability and running performance, a negative-charging electrophotographic photosensitive member which can be improved in chargeability and sensitivity and can make photo-memory and smeared images less occur, both at high levels, and hence can dramatically be improved in image quality.

Stated specifically, according to an embodiment, the present invention is a negative-charging electrophotographic photosensitive member comprising an aluminum or aluminum alloy substrate and at least a film and a light-receiving layer which are superposed in this order from the substrate, wherein;

the film has a layer thickness of from 0.5 nm to 15 nm, comprises aluminum atoms, silicon atoms and oxygen atoms, and contains the silicon atoms in an amount of from 0.1 atomic part to 1 atomic part and the oxygen atoms in an amount of from 1 atomic part to 5 atomic parts both based on 1 atomic part of the aluminum atoms; and the light-receiving layer has at least a lower-part charge injection blocking layer formed of a non-single crystal silicon film comprises at least silicon atoms, nitrogen atoms and oxygen atoms, not doped with any impurities; a photoconductive layer formed of a non-single crystal silicon film comprising at least silicon atoms; an upper-part charge injection blocking layer formed of a non-single crystal silicon film comprising at least silicon atoms, carbon atoms and atoms belonging to the Group 13 of the periodic table; and a surface protective layer formed of a non-single crystal silicon film comprising at least silicon atoms, carbon atoms, which layers are superposed in this order from the substrate.

According to another embodiment, the present invention is a negative-charging electrophotographic photosensitive member comprising an aluminum or aluminum alloy substrate and at least a film and a light-receiving layer which are superposed in this order from the substrate, wherein;

the film has a layer thickness of from 0.5 nm to 15 nm, comprises at least aluminum atoms, silicon atoms and oxygen atoms and contains the silicon atoms in an amount of from 0.1 atomic part to 1 atomic part and the oxygen atoms in an amount of from 1 atomic part to 5 atomic parts both based on 1 atomic part of the aluminum atoms; and the light-receiving layer has at least a lower-part charge injection blocking layer and a photoconductive layer having a first photoconductive layer and a second photoconductive layer which are superposed in this order from the substrate;

the lower-part charge injection blocking layer being formed of a non-single crystal silicon film comprising at least silicon atoms, nitrogen atoms, oxygen atoms, and one of hydrogen atoms and halogen atoms, not doped with any impurities;

the photoconductive layer being formed of a non-single crystal silicon film comprising at least silicon atoms and one of hydrogen atoms and halogen atoms;

the first photoconductive layer containing atoms belonging to the Group 15 of the periodic table in an amount of from 0.01 atomic ppm to 10 atomic ppm based on the silicon atoms; and the second photoconductive layer not containing any atoms belonging to the Group 13 of the periodic table.

According to still another embodiment, the present invention is a negative-charging electrophotographic photosensitive member comprising an aluminum or aluminum alloy substrate and at least a film and a light-receiving layer which are superposed in this order from the substrate, wherein;

the film has a layer thickness of from 0.5 nm to 15 nm, comprises at least aluminum atoms, silicon atoms and oxygen atoms, and contains the silicon atoms in an amount of from 0.1 atomic part to 1 atomic part and the oxygen atoms in an amount of from 1 atomic part to 5 atomic parts both based on 1 atomic part of the aluminum atoms; and the light-receiving layer has at least a lower-part charge injection blocking layer and a photoconductive layer having a first photoconductive layer and a second photoconductive layer which are superposed in this order from the substrate;

the lower-part charge injection blocking layer being formed of a non-single crystal silicon film comprising at least silicon atoms, nitrogen atoms, oxygen atoms, and one of hydrogen atoms and halogen atoms, not doped with any impurities;

the photoconductive layer being formed of a non-single crystal silicon film comprising at least silicon atoms and one of hydrogen atoms and halogen atoms;

the first photoconductive layer containing atoms belonging to the Group 15 of the periodic table in an amount of from 0.01 atomic ppm to 10 atomic ppm based on the silicon atoms; and the second photoconductive layer containing atoms belonging to the Group 13 of the periodic table in an amount of 15 atomic ppm or less.

The film may be formed using water containing an inhibitor. Where a silicate is used as the inhibitor, the film is referred to also as a silicate film. Also, the non-single crystal silicon is meant to include polycrystalline silicon and amorphous silicon (a-Si). It is common for the light-receiving layer of the electrophotographic photosensitive member to be produced from amorphous silicon.

DETAILED DESCRIPTION OF THE PREFERRED EMBODIMENTS

Figure 1:
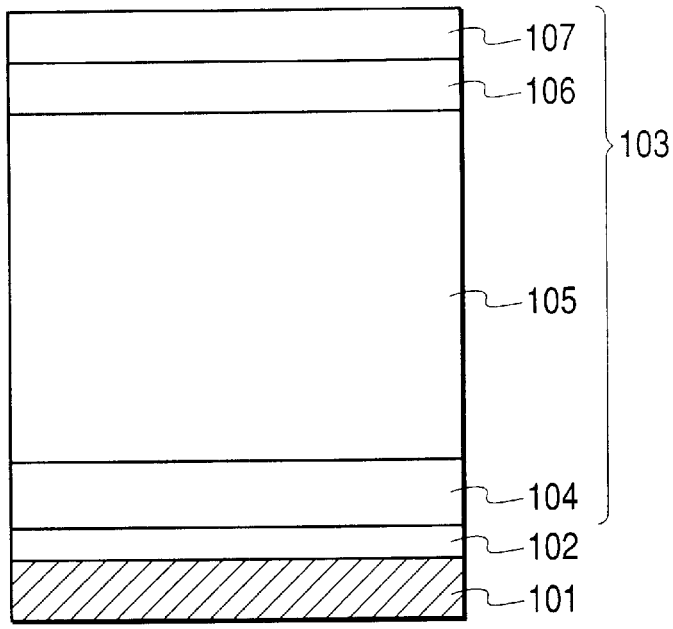
FIG. 1 is a diagrammatic sectional view illustrating an example of layer construction of the electrophotographic photosensitive member according to the present invention.

In order to solve the problems discussed above, the present inventors have made studies under conditions extending in variety, on a negative-charging electrophotographic photosensitive member having a lower-part charge injection blocking layer, a photoconductive layer, an upper-part charge injection blocking layer and a surface protective layer which are provided in optimum construction on an aluminum-based substrate having a silicate film formed thereon. As the result, they have discovered that the mobility of carriers can be improved by setting the charge polarity of the electrophotographic photosensitive member negative-charging to change the photo-carriers from holes to electrons and this can make the photo-memory, in particular, the ghost remarkably less occur.

They have also discovered that an upper-part charge injection blocking layer formed of a non-single crystal silicon carbide film comprising at least silicon atoms, carbon atoms and atoms belonging to the Group 13 of the periodic table contributes to an improvement in chargeability and sensitivity and also to prevention of the smeared images on intense exposure, what is called smeared EV, which causes blurred letters or characters because the photo-carriers are produced in a large quantity because of application of intense exposure to cause a phenomenon that the photo-carriers gather to and flow into the part to which they can readily move.

The present inventors have made extensive studies also on chargeability in the negative-charging electrophotographic photosensitive member. As the result, they have discovered that the combination of a silicate film formed on an aluminum-based substrate with a lower-part charge injection blocking layer containing nitrogen atoms and oxygen atoms enables formation of a good interface when deposited films are formed and brings about a dramatic improvement in charge-blocking performance because the layer can effectively block the holes and allows the electrons to pass smoothly, and this enables remarkable improvement in chargeability, particularly, simultaneous achievement of the improvement in photosensitivity, the lessening of photo-memory and the improvement in chargeability all at high levels especially in respect of the negative-charging electrophotographic photosensitive member.

In addition, because of the effect of modifying the interface that the silicate film and the lower-part charge injection blocking layer form, the blocking performance can well be maintained without adding to the lower-part charge injection blocking layer any impurity atoms belonging to the Group 13 and Group 15 of the periodic table which have been added in conventional photosensitive members, and this has brought about the effect of making the photo-memory, in particular, the ghost dramatically less occur.

In respect of a negative-charging electrophotographic photosensitive member adaptable to the achievement of high image quality, the present inventors have taken note of the behavior of carriers in the photoconductive layer and the construction of the photoconductive layer, and have made extensive studies on the relationship between the distribution of atoms belonging to the Group 13 of the periodic table (Group-13 atoms) and atoms belonging to the Group 15 of the periodic table (Group-15 atoms) which are substances capable of controlling conductivity in the photoconductive layer, and the photosensitivity and the photo-memory. As the result, they have reached a finding that the object of the present invention can be achieved where, with regard to the layer construction of the negative-charging electrophotographic photosensitive member, the photoconductive layer may be so formed in two layers that the Group-13 atoms and Group-15 atoms stand distributed therein respectively in specific ranges and also the lower-part charge injection blocking layer containing nitrogen atoms and oxygen atoms, containing them in specific amount, and the silicate film formed on the aluminum-based substrate are formed in combination.

Stated more specifically, they have discovered that the photo-memory can be made to less occur and the photosensitivity can be improved, both dramatically, because the negative-charging electrophotographic photosensitive member allows use of an image exposure method which enables achievement of high image quality even with use of a negatively chargeable toner and in which image areas are exposed, and also because, in respect of the photoconductive layer constituted of a non-single crystal material containing silicon atoms and hydrogen atoms and/or halogen atoms, the distribution of the Group-13 atoms and Group-15 atoms is so controlled in two layers that these atoms correlate to each other. The latter is done in respect of light-incident areas especially concerned with photoelectric conversion, taking account of the roles of the part which the light enters and the other part, in order to optimize the photoconductive layer to long-wavelength light (such as laser light or LED light) adapted to digitization.

They have also discovered that the combination of the silicate film formed on an aluminum-based substrate with the lower-part charge injection blocking layer containing nitrogen atoms and oxygen atoms enables great improvement in charge-blocking performance and also improvement in chargeability without adding any Group-13 and Group-15 impurity atoms to the lower-part charge injection blocking layer.

Accordingly, the lower-part charge injection blocking layer may preferably be formed of a non-single crystal silicon film comprising at least silicon atoms, nitrogen atoms, oxygen atoms, and one of hydrogen atoms and halogen atoms.

They have still also discovered that the incorporation of nitrogen atoms and oxygen atoms in the lower-part charge injection blocking layer formed on the silicate film enables improvement in charge-blocking performance without adding any Group-13 and Group-15 impurity atoms to the lower-part charge injection blocking layer.

From the viewpoint of the foregoing, in the lower-part charge injection blocking layer, the nitrogen atoms and oxygen atoms may preferably be in a content of 0.1 atomic % or more, and more preferably 1.2 atomic % or more, and of 40 atomic % or less, and more preferably 20 atomic % or less, in total, based on the silicon atoms.

In order to solve the problems discussed previously, the present inventors have examined performances of electrophotographic photosensitive members under conditions extending in variety. First, taking account of the fact that, in order to improve the image quality of digital full-color copying machines, it is essential to use a negatively chargeable toner in the image exposure method in which image areas are exposed, they have pushed studies forward on condition that the charging polarity of an electrophotographic photosensitive member is the negative polarity. As the result, they have discovered that a negative-charging electrophotographic photosensitive member constructed to have a photoconductive layer consisting of two layers in which atoms capable of controlling conductivity have been distributed, and so constructed that carriers have an optimum mobility, can make the photo-memory less occur and can be improved in photosensitivity, both dramatically.

The photo-memory is considered to occur because photo-carriers produced upon imagewise exposure remain in the photoconductive layer. More specifically, any carriers having remained among photo-carriers produced in a certain copying step are swept out at the time of the next charging or after that by the action of an electric field formed by surface electric charges. This causes a potential difference between the part to which the imagewise exposure light has been applied and the part other than that, so that a difference in density is produced on images. Hence, it is considered effective that such carriers do not remain as far as possible, in order to make the photo-memory less occur. Accordingly, the mobility of photo-carriers must be improved so that the photo-carriers can travel in one-time copying step without remaining in the photoconductive layer as far as possible. With regard to photosensitivity, too, a low sensitivity may also result when photo-carriers produced upon imagewise exposure and trapped in the film come to tend to remain. Accordingly, the mobility of photo-carriers must be improved so that the photo-carriers can travel in one-time copying step without remaining in the photoconductive layer as far as possible.

In the present invention, the photoconductive layer may be so constructed that any Group-13 atoms are not incorporated in a second photoconductive layer in which carriers are produced on the free-surface side, or, even when incorporated, in the necessary and minimum quantity. This can make the photoconductive layer, formed chiefly of amorphous silicon, have a conductivity close to weak n-type or i-type and sufficient mobility of holes can be ensured.

From the viewpoint of the foregoing, any Group-13 atoms are not incorporated in the second photoconductive layer, or, even when incorporated, in a content of 15 atomic ppm or less, and preferably 7 atomic ppm or less, based on the silicon atoms. In the case when the Group-13 atoms are incorporated in the second photoconductive layer, they may preferably be in an amount of 0.01 atomic ppm or more based on the silicon atoms to ensure sufficient effect of addition.

Incorporation of Group-15 atoms in a first photoconductive layer which is on the substrate side also brings about a more improvement in the mobility of electrons, makes the photo-memory much less occur and brings about a more improvement in sensitivity. Especially where long-wavelength laser light adapted to digitization is used, the mobility of photo-carriers can effectively be controlled by the double-layer photoconductive layer according to the present invention.

From the viewpoint of the foregoing, in the first photoconductive layer, the Group-15 atoms may be added in an amount of 0.01 atomic ppm or more, and preferably 0.05 atomic ppm or more, and of 10 atomic ppm or less, and preferably 5 atomic ppm or less.

As stated above, the formation of the photoconductive layer in two layers brings about a dramatic improvement in photosensitivity of the negative-charging electrophotographic photosensitive member and makes the photo-memory thereof dramatically less occur. However, taking account of the adaptation to digital full-color copying machines, it is desirable to improve chargeability further.

The present inventors have made extensive studies also on chargeability in the negative-charging electrophotographic photosensitive member. As the result, as stated previously they have discovered that the combination of the silicate film formed on an aluminum-based substrate with the lower-part charge injection blocking layer containing nitrogen atoms and oxygen atoms brings about a dramatic improvement in charge-blocking performance of holes, and this enables simultaneous achievement of the improvement in photosensitivity, the lessening of photo-memory and the improvement in chargeability all at high levels especially in respect of the negative-charging electrophotographic photosensitive member.

Where such an improvement in chargeability is achieved by improving the construction of the respective lower-part charge injection blocking layer, photoconductive layer and surface layer, an improvement in chargeability, even when achieved, may exert a bad influence on photosensitivity and photo-memory depending on how they are constructed. In particular, the bad influence on photo-memory may greatly affect image characteristics in the digital full-color copying machine. Hence, it is important to control the bad influence on photosensitivity and photo-memory and simultaneously improve the chargeability dramatically. In the present invention, in order to make it possible to control the bad influence on photosensitivity and photo-memory and improve the chargeability dramatically, the silicate film is formed between the aluminum-based substrate and the lower-part charge injection blocking layer. As the result, it has been ascertained that the combination of the silicate film with the lower-part charge injection blocking layer containing oxygen atoms and nitrogen atoms only in specific quantity, which is one of unique construction of the negative-charging electrophotographic photosensitive member, has a good effect on the charge blocking performance of holes. It has also been revealed that such combination little exerts a bad influence on photosensitivity and photo-memory.

Thus, the negative-charging electrophotographic photosensitive member comprising combination of the photoconductive layer consisting of two layers in which atoms capable of controlling conductivity have been distributed with the lower-part charge injection blocking layer containing oxygen atoms and nitrogen atoms and also with the silicate film formed between the aluminum-based substrate and the lower-part charge injection blocking layer can dramatically be improved in chargeability and sensitivity and can make photo-memory much less occur, both at high levels, and hence can dramatically be improved in image quality of digital full-color copying machines.

The negative-charging electrophotographic photosensitive member of the present invention also has performances having been optimized to digital full-color copying machines. Needless to say, very good images are obtainable also when it is mounted to digital monochromatic copying machines.

The negative-charging electrophotographic photosensitive member of the present invention is described below with reference to the accompanying drawings.

FIG. 1 illustrates an example of preferred layer construction of the electrophotographic photosensitive member according to the present invention. In this instance, it comprises a cylindrical aluminum-based substrate 101 and a light-receiving layer 103 provided thereon. Between the cylindrical aluminum-based substrate 101 and the light-receiving layer 103, a silicate film 102 is formed. The light-receiving layer 103 is constituted of a lower-part charge injection blocking layer 104, a photoconductive layer 105, an upper-part charge injection blocking layer 106 and a surface protective layer 107 in this order from the substrate side.

Substrate

The substrate is commonly cylindrical, and the aluminum-based substrate may be made of any material as long as it comprises aluminum as a base material. What is suited for the present invention is a material containing at least one atoms of Fe, Si and Cu each in an amount of 10 atomic ppm or more based on aluminum atoms, provided that the atoms contained are in a total weight of from 0.01% by weight to 1% by weight of the aluminum atoms.

In order to improve the workability of the substrate, it is also effective to incorporate magnesium atoms. The magnesium atoms may preferably be incorporated in a content of 0.1% by weight or more, and more preferably 0.2% by weight or more of the aluminum atoms, and of preferably 10% by weight or less, and more preferably 5% by weight or less of the aluminum atoms.

It is also effective to incorporate any of H, Na, K, Be, Ca, Ti, Cr, Mn, Mo, Fe, Co, Ni, Nb, Te, V, Pt, Pb, Cu, Ag, Au, Zn, Cd, Hg, B, Ca, In, C, Si, Ge, Sn, N, P, As, O, S, Se, F, Cl, Br and I in the aluminum.

The surface of the cylindrical substrate is worked by means of a lathe or the like. For example, the surface is mirror-finished according to the following procedure. That is, a diamond turning tool (trade name: MIRACLE BITE; manufactured by Tokyo Diamond K.K.) is so set on a precision cutting lathe with an air damper (manufactured by Pneumo Precision Co.) as to provide a rake angle of 5° with respect to the cylinder center angle. Next, the substrate is vacuum-chucked to a rotary flange of this lathe, where illuminating kerosene is sprayed from a nozzle attached thereto and cutting dust and chips are sucked from a vacuum nozzle attached similarly, under combination of which the substrate surface is mirror-cut under conditions of a peripheral speed of 1,000 m/min. and a feed rate of 0.01 mm/R so as to provide the desired outer diameter.

Before a film formation step of forming a deposited film on the surface of the cylindrical substrate thus worked, the substrate surface is degreased and cleaned. In that course, a silicate film described below is formed.

Silicate Film

The silicate film is an Al—Si—O film comprising at least aluminum, silicon and oxygen atoms, formed using an aqueous cleaning agent in which a silicate has been dissolved as a corrosion inhibitor. The formation of such a silicate on the substrate surface can make the substrate surface have less defects, and the formation of the light-receiving layer on that film enables formation of a negative-charging electrophotographic photosensitive member which may cause no image defects and can achieve an improvement of electrophotographic performances such as charging performance and photosensitivity.

It is especially effective to form the silicate film on an aluminum substrate containing Si, Fe and Cu.

Before deposited films are formed on the aluminum-based substrate the surface of which has been mirror-cut by means of a lathe or the like, the aluminum-based substrate is treated through, e.g., a degreasing wash step of degreasing and cleaning the substrate surface, a silicate film formation step of forming the silicate film, a rinsing step of rinsing the substrate surface and a drying step of drying the substrate surface, in this order. In the silicate film formation step, an aqueous cleaning agent containing a surface-active agent may be introduced to remove fats and oils, halides and so forth on the substrate and a silicate may further be added thereto to form its film on the surface of the aluminum-based substrate. Also, after the film has once been formed on the substrate, pure water may be used in the rinsing step and the drying step.

The silicate film may be formed by a method in which, in the degreasing wash step after cutting, a silicate is incorporated in the aqueous cleaning agent containing a surface-active agent, a method in which any silicate is not used in the degreasing wash step and the silicate is used in the rinsing step, or a method in which any silicate is not used in the degreasing wash step and the silicate is used in the rinsing step and the drying step, or a method in which the silicate is used in all the steps. Any of these methods may preferably be used.

The silicate may include potassium silicate and sodium silicate, any of which may be used. Potassium silicate is particularly preferred.

The potassium silicate may preferably be in a concentration of from 0.1% by weight to 2% by weight, which is concentration not causative of any stains on the substrate.

The silicate film formed on the aluminum-based substrate may preferably be in a layer thickness of 0.5 nm or more, preferably 1 nm or more, and more preferably 1.5 nm or more, from the viewpoint of ensuring a sufficient effect of the film. As for its upper limit, it may be in a layer thickness of 15 nm or less, preferably 13 nm or less, and more preferably 12 nm or less, from the viewpoint of ensuring a sufficient conductivity of the substrate.

The Al—Si—O film formed on the aluminum-based substrate may be in a compositional ratio having the contents of silicon atoms and oxygen atoms in proper ranges, whereby sufficient performance and appropriate conductivity as a film can be achieved. The film is considered to contribute also to the construction of an interface with the deposited film, and is understood to contribute to improvements in charging performance and so forth.

From the viewpoint of the foregoing, the silicon atoms may be in a content of 0.1 atomic part or more, preferably 0.15 atomic part or more, and more preferably 0.2 atomic part or more, and of 1 atomic part or less, preferably 0.8 atomic part or less, and more preferably 0.6 atomic part or less, based on 1 atomic part of Al atoms. As for the oxygen atoms, they may be in a content of 1 atomic part or more, preferably 1.5 atomic part or more, and more preferably 2 atomic part or more, and of 5 atomic part or less, preferably 4 atomic part or less, and more preferably 3.5 atomic part or less, based on 1 atomic part of Al atoms.

The silicate film may also be incorporated with nitrogen atoms. The nitrogen atoms are considered to contribute to adherence to the deposited film and relaxation of stress, bringing about an improvement in adherence to the deposited film. Also, like the silicon atoms and oxygen atoms, the nitrogen atoms are considered to contribute also to the construction of an interface with the deposited film, and is understood to contribute to an improvement in charging performance. From the viewpoint of the foregoing, the nitrogen atoms may preferably be in a content of from 1 atomic ppm to 10 atomic %, and more preferably from 100 atomic ppm to 1 atomic %, based on aluminum atoms.

The nitrogen atoms may preferably be incorporated by adding amino alcohol or benzotriazole in the silicate film formation step. Such an additive may be added in the degreasing wash step. Also, the additive may preferably be added alone, or may also preferably be added in the form of a mixture of a plurality of types.

Fluorine atoms may preferably further be incorporated in a content of from 1 atomic ppm to 10 atomic ppm based on 1 of the aluminum atoms.

Figure 3:
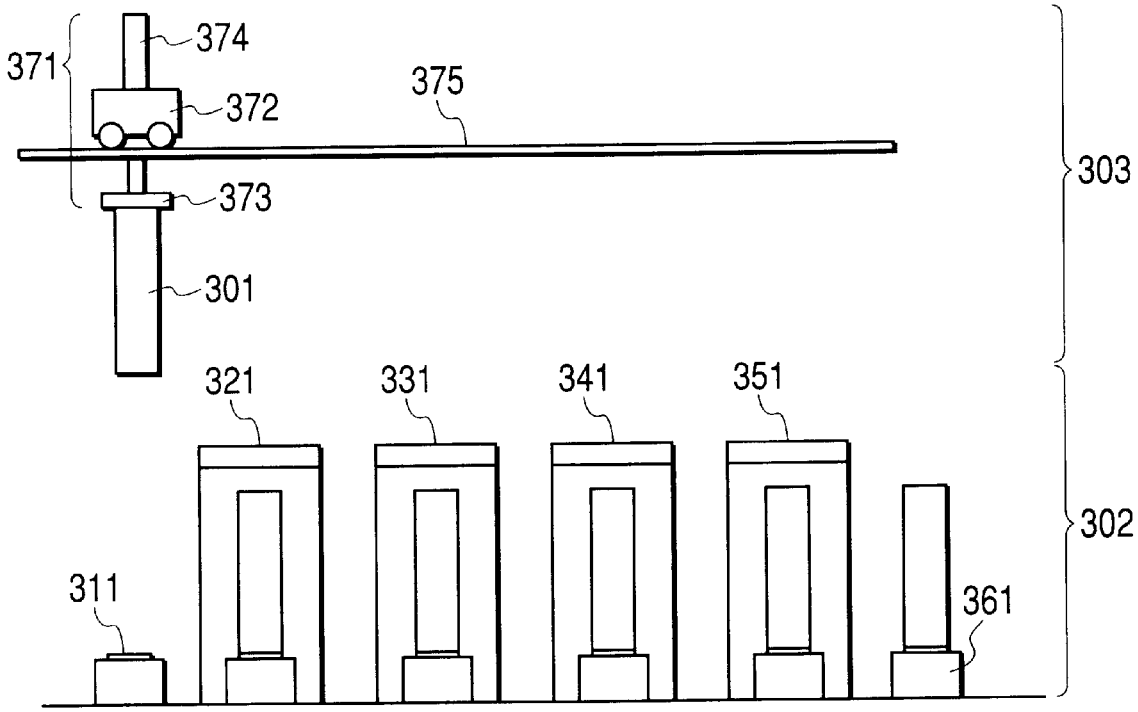
FIG. 3 is a diagrammatic view illustrating a procedure for forming a silicate film.

A procedure according to which the silicate film is formed on the cylindrical substrate having been mirror-cut is described below. A washing system (washer) for forming the layer of silicate film on the substrate surface and washing the substrate surface is shown in FIG. 3.

The washing system consists of a treating section 302 and a substrate transport mechanism 303. The treating section 302 consists of a substrate feed stand 311, a degreasing wash chamber 321, a silicate film formation chamber 331, a rinsing chamber 341, a drying chamber 351 and a substrate delivery stand 361. The respective chambers are fitted with temperature control units (not shown) for keeping the liquid temperature constant. The transport mechanism 303 consists of a transport rail 375 and a transport arm 371, and the transport arm 371 consists of a moving mechanism 372 which moves on the rail 375, a chucking mechanism 373 which holds the substrate 301, and an air cylinder 374 for up and down moving the chucking mechanism 373.

The substrate 301 placed on the feed stand 311 is transported to the degreasing wash chamber (wash chamber 1) 321 by means of the transport mechanism 303. The degreasing wash chamber 321 holds therein an aqueous cleaning composition containing a surface-active agent. Any dust, fats and oils and so forth adhering to the surface are washed away therein by ultrasonic cleaning of the substrate 301.

The substrate 301 on which the degreasing wash step has been finished is then carried to the silicate film formation chamber (wash chamber 2) 331 by means of the transport mechanism 303, where the silicate film is formed. The silicate film formation chamber 331 holds therein an aqueous cleaning composition prepared by, e.g., adding a surface-active agent to an aqueous solution containing potassium silicate in a concentration of 0.5% and kept at 27° C. In this chamber, any dust, fats and oils and so forth adhering to the surface are also washed away by ultrasonic cleaning, during which the silicate film is formed on the surface of the substrate 301.

The substrate 301 on which the silicate film formation step has been finished is then sent to the rinsing step. It is carried to the rinsing chamber (wash chamber 3) 341 by means of the transport mechanism 303, where the substrate is further rinsed with pure water kept at a temperature of 25° C. As to the pure water, its purity is controlled by an industrial conductivity meter (trade name: α900R/C; manufactured by Horiba Seisakusho K.K.) so as to be kept constant. The substrate 301 on which the rinsing step has been finished is then sent to the drying step. The substrate 301 is moved to the drying chamber (wash chamber 4) 351, which holds therein pure water kept at a temperature of 60° C., by means of the transport mechanism 303, where the substrate is drawn up by means of a lifting system (not shown) and dried. As to the pure water, its purity is controlled by an industrial conductivity meter (trade name: α900R/C; manufactured by Horiba Seisakusho K.K.) so as to be kept constant.

The substrate 301 on which the drying step has been finished is carried to the delivery stand 361 by means of the transport mechanism 303, and then delivered out of the washing system shown in FIG. 3.

Lower-Part Charge Injection Blocking Layer

At a lower layer of the photoconductive layer is formed, a lower-part charge injection blocking layer having the function to block the injection of electric charges from the substrate side. The lower-part charge injection blocking layer has the function to prevent electric charges from being injected from the substrate side to the photoconductive layer side when the light-receiving layer is subjected to charging in a certain polarity on its free surface, and exhibits no such function when subjected to charging in a reverse polarity.

Stated specifically, it has the function to prevent holes from being injected into the photoconductive layer side from the substrate side when the light-receiving layer is subjected to charging in the negative polarity.

Here, the lower-part charge injection blocking layer is not doped with any impurities such as Group-13 atoms and Group-15 atoms, and is chiefly formed of an intrinsic non-single crystal silicon film, and preferably an intrinsic amorphous silicon film. In such a case, the formation of the lower-part charge injection blocking layer on the aluminum-based substrate on which the silicate film has been formed brings about a more improvement in adherence and interface construction between the silicate film and the lower-part charge injection blocking layer to improve electrophotographic performances.

This also enables reduction of production cost because any source gas for doping is not used. This further enables achievement of good productivity because it is unnecessary to control any trace impurity content in a high precision.

The lower-part charge injection blocking layer, which is constituted of a non-single crystal material which contains at least nitrogen atoms and oxygen atoms, may also preferably contain hydrogen atoms and/or halogen atoms. Employment of such constitution enables improvement in adherence between the lower-part charge injection blocking layer and the cylindrical substrate to achieve superior charge blocking performance of holes.

The nitrogen atoms and oxygen atoms incorporated in the lower-part charge injection blocking layer may evenly uniformly be distributed in the layer, or may be evenly contained in the layer thickness direction but contained partly in such a state that they are distributed non-uniformly. In the case when they are distributed in non-uniform concentration, they may preferably be contained so as to be distributed in a larger quantity on the substrate side. In any case, however, in the in-plane direction parallel to the surface of the substrate, it is necessary for such atoms to be evenly contained in a uniform distribution so that the properties in the in-plane direction can be made uniform.

The nitrogen atoms and oxygen atoms are incorporated in the lower-part charge injection blocking layer over its whole area, and if necessary, carbon atoms may also be incorporated therein over the whole area. The total amount of those to be added among these atoms depends on the characteristics of the electrophotographic photosensitive member to be obtained. It may preferably be 0.1 atomic % or more, more preferably 1 atomic % or more, and still more preferably 5 atomic % or more, and be 40 atomic % or less, more preferably 30 atomic % or less, and still more preferably 20 atomic % or less, based on silicon atoms.

As long as the sum of the nitrogen atoms and oxygen atoms are in a content of 0.1 atomic % or more based on silicon atoms, the chargeability can be improved and the adherence between the lower-part charge injection blocking layer and the substrate can be improved. This enables films to be kept from peeling. In addition, as long as it is in a content of 40 atomic % or less, the lower-part charge injection blocking layer can be made to have an appropriate electrical resistance and any residual potential can be lessened.

The hydrogen atoms and/or halogen atoms also compensate unbonded arms of silicon atoms present in the lower-part charge injection blocking layer and improve film quality. The total of atoms to be added among these atoms may preferably be in a content of 1 atomic % or more, more preferably 5 atomic % or more, and still more preferably 10 atomic % or more, and of preferably 50 atomic % or less, more preferably 40 atomic % or less, and still more preferably 30 atomic % or less, based on silicon atoms.

The lower-part charge injection blocking layer may preferably have a layer thickness of 0.1 $\mu$m or more, more preferably 0.3 $\mu$m or more, and still more preferably 0.5 $\mu$m or more, and of preferably 5 $\mu$m or less, more preferably 4 $\mu$m or less, and still more preferably 3 $\mu$m or less, from the viewpoint of the desired electrophotographic performances, economical advantages and so forth. As long as it has a layer thickness of 0.1 $\mu$m or more, the injection of electric charges from the substrate can sufficiently be blocked. As long as it has a layer thickness of 5 $\mu$m or less, the layer can be formed in a short time to enable reduction of production cost, without lowering any electrophotographic performances.

The lower-part charge injection blocking layer may be formed by vacuum deposition. In order to form a lower-part charge injection blocking layer having the desired characteristics, it is necessary to appropriately set the mixing proportion of Si-feeding gas and diluent gas, the gas pressure inside the reactor, the discharge power and the substrate temperature.

The flow rate of $H_2$ and/or He optionally used as diluent gas(es) may appropriately be selected within an optimum range in accordance with the designing of layer construction. The flow rate of $H_2$ and/or He may usually be controlled within the range of from 0.3 to 20 times, preferably from 0.5 to 15 times, and most preferably from 1 to 10 times, based on the Si-feeding gas.

The gas pressure inside the reactor may also appropriately be selected within an optimum range in accordance with the designing of layer construction. It may usually be controlled in the range of from $1.0\times10^{-2}$ to $1.0\times10^{3}$ Pa, preferably from $5.0\times10^{-2}$ to $5.0\times10^{2}$ Pa, and most preferably from $1.0\times10^{-1}$ to $1.0\times10^{2}$ Pa.

The discharge power may still also appropriately be selected within an optimum range in accordance with the designing of layer construction, where the ratio of the discharge power to the flow rate of Si-feeding gas may usually be controlled in the range of from 0.5 to 8, preferably from 0.8 to 7, and most preferably from 1 to 6.

The temperature of the substrate may also appropriately be selected within an optimum range in accordance with the designing of layer construction. The temperature may usually preferably be set in the range of from 200 to 350° C., more preferably from 230 to 330° C., and most preferably from 250 to 310° C.

Preferable numerical values for the above gas mixing ratio, gas pressure discharge power and substrate temperature to form the lower-part charge injection blocking layer may be within the above ranges. These film formation factors, however, are by no means independently separately determined in usual cases. Optimum values for forming the respective layers should be determined on the basis of mutual and systematic relationship so that the lower-part charge injection blocking layer having the desired characteristics can be formed.

Photoconductive Layer

The photoconductive layer is formed by a vacuum-deposition film formation process under conditions appropriately numerically set in accordance with film-forming parameters so as to achieve the desired performances. Stated specifically, it may be formed by various thin-film deposition processes as exemplified by glow discharging (including AC discharge CVD such as low-frequency CVD, high-frequency CVD or microwave CVD, and DC discharge CVD), and sputtering, vacuum metallizing, ion plating, photo-assisted CVD and thermal CVD. These thin-film deposition processes may be employed under appropriate selection according to the conditions for manufacture, the extent of a load on capital investment in equipment, the scale of manufacture and the properties and performances desired on electrophotographic photosensitive members to be produced. Glow discharging, in particular, high-frequency glow discharging making use of RF-band power source frequency is preferred in view of their relative easiness to control conditions in the manufacture of electrophotographic photosensitive members having the desired performances.

To form the photoconductive layer comprising silicon atoms as a matrix by glow discharging, basically an Si-feeding source gas capable of feeding silicon atoms (Si), and an H-feeding source gas capable of feeding hydrogen atoms (H) and/or an X-feeding source gas capable of feeding halogen atoms (X) may be introduced in the desired gaseous state into a reactor whose inside can be evacuated, and glow discharge may be caused to take place in the reactor so that a layer comprised of amorphous silicon incorporated with hydrogen atoms and/or halogen atoms (a-Si:H,X) is formed on a given substrate previously set at a given position.

The photoconductive layer may preferably be incorporated with hydrogen atoms and/or halogen atoms. These atoms compensate unbonded arms of silicon atoms in the layer and improve layer quality, in particular, improve photoconductivity and charge retentivity. The total of atoms to be added among these atoms may preferably be in a content of from 10 to 40 atomic %, based on the total of the silicon atoms and the atoms to be added.

The material that may serve as the Si-feeding gas may include gaseous or gasifiable silicon hydrides (silanes) such as $SiH_4$ $Si_2H_6$, $Si_3H_8$ and $Si_4H_{10}$, which may effectively be used. In view of readiness in handling for layer formation and Si-feeding efficiency, the material may preferably include $SiH_4$ and $Si_2H_6$.

To structurally incorporate the hydrogen atoms into the photoconductive layer to be formed and in order to make it more easy to control the percentage of the hydrogen atoms to be incorporated, to materialize the desired film properties, the layer may be formed further mixing at least one of $H_2$, He and a gas of a silicon compound containing hydrogen atoms. Each gas may be mixed not only alone in a single species but also in combination of plural species in a desired mixing ratio, without any problems.

A material effective as a source gas for feeding halogen atoms may preferably include gaseous or gasifiable halogen compounds as exemplified by halogen gases, halides, halogen-containing interhalogen compounds and silane derivatives substituted with a halogen atom. The material may also include gaseous or gasifiable, halogen-containing silicon hydride compounds constituted of silicon atoms and halogen atoms, which may also be effective. Halogen compounds that may particularly preferably be used may specifically include fluorine gas ($F_2$) and interhalogen compounds such as BrF, ClF, $ClF_3$, $BrF_3$, $BrF_5$, $IF_3$ and $IF_7$. Silicon compounds containing halogen atoms, what is called silane derivatives substituted with halogen atoms, may specifically include silicon fluorides such as $SiF_4$ and $Si_2F_6$, which are preferable examples.

To control the quantity of the hydrogen atoms and/or halogen atoms incorporated in the photoconductive layer, for example the temperature of the substrate, the quantity of source materials used to incorporate the hydrogen atoms and/or halogen atoms, the discharge power and so forth may be controlled.

Into the photoconductive layer, atoms capable of controlling its conductivity may also be incorporated. The atoms capable of controlling conductivity may include what is called impurities, used in the field of semiconductors, and it is possible to use atoms belonging to Group 13 of the periodic table (hereinafter also simply "Group-13 atoms") capable of imparting p-type conductivity.

The Group-13 atoms may specifically include boron (B), aluminum (Al), gallium (Ga), indium (In) and thallium (Tl). In particular, B, Al and Ga are preferred.

To structurally incorporate the atoms capable of controlling conductivity, e.g., Group-13 atoms, a source material for incorporating Group-13 atoms may be fed, when the layer is formed, into the reactor in a gaseous state together with other gases used to form the photoconductive layer. Those which may serve as the source material for incorporating Group-13 atoms should be selected from those which are gaseous at normal temperature and normal pressure or at least those which are readily gasifiable under conditions for the layer formation.

Such a source material for incorporating Group-13 atoms may specifically include, as a material for incorporating boron atoms, boron hydrides such as $B_2H_6$, $B_4H_{10}$, $B_5H_9$, $B_5H_{11}$, $B_6H_{10}$, $B_6H_{12}$ and $B_6H_{14}$, and boron halides such as $BF_3$, $BCl_3$ and $BBr_3$. Besides, the material may also include $AlCl_3$, $GaCl_3$, $Ga(CH_3)_3$, $InCl_3$ and $TlCl_3$.

These source materials for incorporating the atoms capable of controlling conductivity may optionally be diluted with $H_2$ and/or He when used.

It is also effective to incorporate at least one of carbon atoms, oxygen atoms and nitrogen atoms. The total of those to be added among these atoms may preferably be in a content of from $1\times10^{-5}$ to 10 atomic %, more preferably from $1\times10^{-4}$ to 8 atomic %, and most preferably from $1\times10^{-3}$ to 5 atomic %, based on the total of the silicon atoms and the atoms to be added.

The thickness of the photoconductive layer may appropriately be determined according to the desired electrophotographic performance, economical advantages and so forth. The layer may preferably be formed in a thickness of from 20 to 50 $\mu$m, more preferably from 23 to 45 $\mu$m, and most preferably from 25 to 40 $\mu$m. As long as it has a layer thickness of 20 $\mu$m or more, sufficient chargeability and sensitivity can be ensured. As long as it has a layer thickness of 50 $\mu$m or less, the layer can be formed in a short time to enable reduction of production cost, without lowering any electrophotographic performances.

In order to form a photoconductive layer having the desired characteristics, it is necessary to appropriately set the mixing proportion of Si-feeding gas and diluent gas, the gas pressure inside the reactor, the discharge power and the substrate temperature.

The gas pressure inside the reactor may also appropriately be selected within an optimum range in accordance with the designing of layer construction. It may usually be controlled in the range of from $1.0\times10^{-2}$ to $1.0\times10^{3}$ Pa, preferably from $5.0\times10^{-2}$ to $5.0\times10^{2}$ Pa, and most preferably from $1.0\times10^{-1}$ to $1.0\times10^{2}$ Pa.

The discharge power may still also appropriately be selected within an optimum range in accordance with the designing of layer construction, where the ratio of the discharge power to the flow rate of Si-feeding gas may usually be controlled in the range of from 0.3 to 8, preferably from 0.8 to 7, and most preferably from 1 to 6.

The temperature of the substrate may also appropriately be selected within an optimum range in accordance with the designing of layer construction. The temperature may usually preferably be set in the range of from 200 to 350° C., more preferably from 230 to 330° C., and most preferably from 250 to 310° C.

Preferable numerical values for the above gas mixing ratio, gas pressure discharge power and substrate temperature to form the photoconductive layer may be within the above ranges. These conditions, however, are by no means independently separately determined in usual cases. Optimum values should be determined on the basis of mutual and systematic relationship so that the photoconductive layer having the desired characteristics can be formed.

Figure 5:
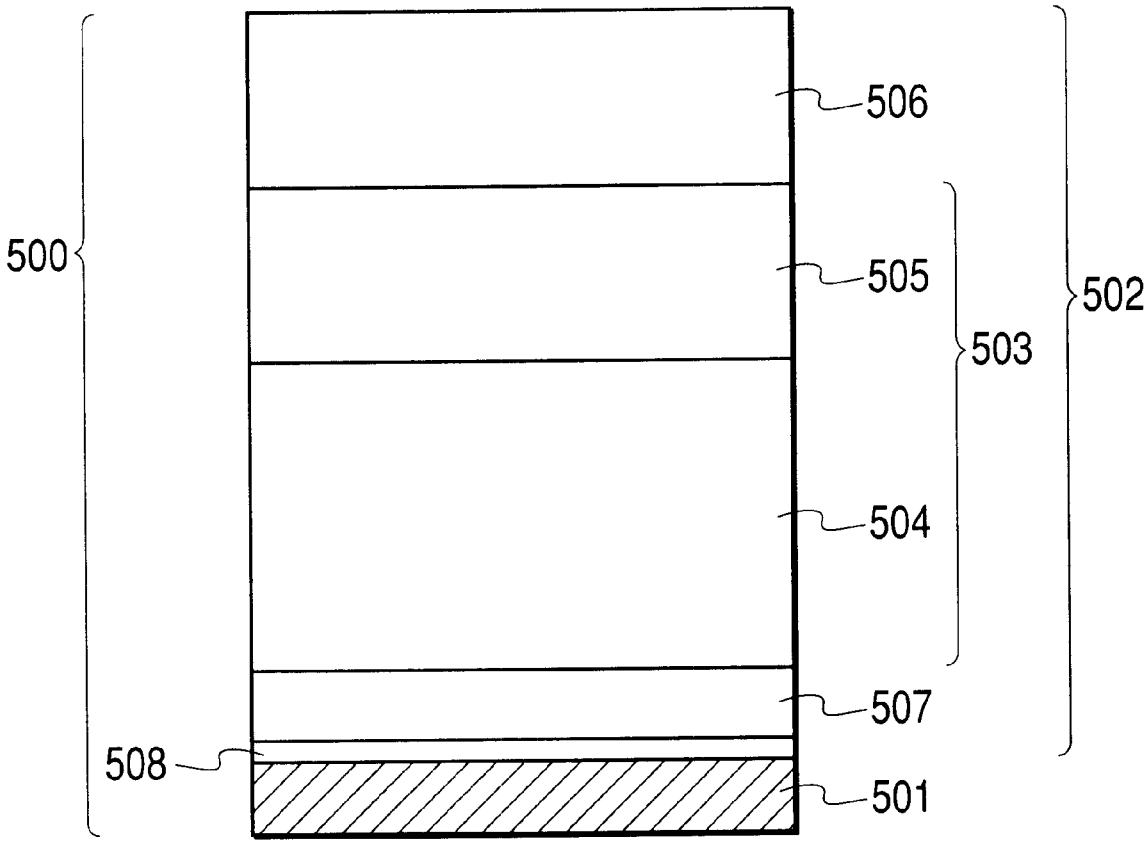
FIG. 5 is a diagrammatic sectional view illustrating an example of layer construction of the electrophotographic photosensitive member according to the present invention.

A negative-charging electrophotographic photosensitive member 500 shown in FIG. 5 comprises an aluminum-based substrate 501 and a light-receiving layer 502 provided thereon. Between the aluminum-based substrate 501 and the light-receiving layer 502, a silicate film 508 is further formed. The light-receiving layer 502 is constituted of a lower-part charge injection blocking layer 507 of amorphous silicon type, a photoconductive layer 503 of amorphous silicon type, having photoconductivity, and a surface protective layer 506 of amorphous silicon type in this order from the aluminum-based substrate 501 side. Also, the photoconductive layer 503 is constituted of a first photoconductive layer 504 and a second photoconductive layer 505 in this order from the lower-part charge injection blocking layer 507 side.

The photoconductive layer of the negative-charging electrophotographic photosensitive member shown in FIG. 5 is constituted of a first photoconductive layer and a second photoconductive layer in this order from the substrate side, and is required to be incorporated with atoms capable of controlling conductivity. This is, in the case of the negative-charging electrophotographic photosensitive member, to regulate or compensate the mobility of holes among the carriers in the second photoconductive layer which have been produced by long-wavelength light and also improve the mobility of electrons in the first photoconductive layer so that the sensitivity and photo-memory characteristics can dramatically be improved. In particular, the formation of the photoconductive layer in two layers in such a way that the mobility of holes in the second photoconductive layer in the negative-charging electrophotographic photosensitive member can be controlled enables achievement of a dramatic effect.

The atoms capable of controlling conductivity may include what is called impurities, used in the field of semiconductors, and atoms belonging to Group 13 of the periodic table ("Group-13 atoms") capable of imparting p-type conductivity and atoms belonging to Group 15 of the periodic table ("Group-15 atoms") capable of imparting n-type conductivity may be used in the second photoconductive layer and the first photoconductive layer, respectively.

The Group-15 atoms in the first photoconductive layer may be in a content of from 0.01 atomic ppm to 10 atomic ppm based on the silicon atoms, and the Group-13 atoms in the second photoconductive layer may be in a content of from 0 atomic ppm to 15 atomic ppm based on the silicon atoms. This is preferable because the mobility of carriers produced in the photoconductive layer can effectively be improved. Also, it is more preferable that the Group-15 atoms in the first photoconductive layer are in a content of from 0.05 atomic ppm to 5 atomic ppm based on the silicon atoms, and the Group-13 atoms in the second photoconductive layer are in a content of from 0.01 atomic ppm to 7 atomic ppm based on the silicon atoms. The atoms capable of controlling conductivity may also evenly uniformly be distributed in the photoconductive layer, or may partly non-uniformly be distributed so as for their content to change in the layer thickness direction of the photoconductive layer.

The Group-13 atoms may specifically include boron (B), aluminum (Al), gallium (Ga), indium (In) and thallium (Tl). In particular, B, Al and Ga are preferred.

The Group-15 atoms may specifically include phosphorus (P), arsenic (As), antimony (Sb) and bismuth (Bi). In particular, P and As are preferred.

To structurally incorporate Group-13 atoms and Group-15 atoms, a source material for incorporating Group-15 atoms as exemplified by phosphine ($PH_3$) gas and a source material for incorporating Group-13 atoms as exemplified by diborane ($B_2H_6$) gas may be fed, when the layer is formed, into the reactor together with other gases used to form the photoconductive layer.

These source materials for incorporating the atoms capable of controlling conductivity may optionally be diluted with $H_2$ and/or He when used.

The second photoconductive layer may also preferably have a layer thickness which enables absorption of 90% or more of peak-wavelength light of imagewise exposure. In such a case, the mobility of carriers produced in the photoconductive layer can effectively be controlled.

The second photoconductive layer may further preferably have a layer thickness which enables absorption of 90% or more of light with wavelengths of 650 nm to 700 nm. In such a case, the mobility of carriers produced in the photoconductive layer can effectively be controlled.

Upper-Part Charge Injection Blocking Layer

Between the photoconductive layer and the surface protective layer, the upper-part charge injection blocking layer is formed by, e.g., a vacuum-deposition film formation process under conditions appropriately numerically set in accordance with film-forming parameters so as to achieve the desired performances.

The upper-part charge injection blocking layer has the function to block the injection of electric charges from the upper part to contributes to an improvement in chargeability and also to prevent the smeared images in intense exposure, what is called smeared EV, which causes blurred letters or characters because the photo-carriers are produced in a large quantity because of application of intense exposure to cause a phenomenon that the photo-carriers gather to and flow into the part to which they can readily move.

Where a surface layer with a high electrical resistance is made to have an upper-part blocking ability as in conventional photosensitive members, carriers having a polarity reverse to the charge polarity produced upon irradiation by light may stay in the surface layer, and such carriers may flow sideways to cause the smeared EV.

To solve this problem, as the upper-part charge injection blocking layer, a non-single crystal silicon film comprising silicon atoms and carbon atoms is incorporated with Group-13 atoms in the desired quantity. This enables regulation of an optimum resistance value at which the carriers having a polarity reverse to the charge polarity are allowed to pass without flowing sideways. Hence, a remarkable improvement can be seen in regard to the smeared EV.

As the chief material of the upper-part charge injection blocking layer, any material may be used as long as it is an a-Si material. For example, an a-Si containing hydrogen atoms (H) and/or halogen atoms (X) and further containing carbon atoms (herein also "a-SiC:H,X") is preferred.

The carbon atoms incorporated in the upper-part charge injection blocking layer may be in a content ranging from 10 atomic % to 70 atomic % based on the sum of silicon atoms and carbon atoms, which may preferably be less than the content of carbon atoms in the surface protective layer.

As long as the content of carbon atoms is 10 atomic % or more based on the sum of silicon atoms and carbon atoms, a good interface with the photoconductive layer can be formed and the ability to block the injection of electric charges can be improved. Also, as long as it is 70 atomic % or less based on the sum of silicon atoms and carbon atoms, proper electrical resistance can be materialized, the electric charges can be kept from flowing sideways and the smeared EV can be kept from occurring, without damaging any charge injection blocking ability.

In addition, since the content of carbon atoms in the upper-part charge injection blocking layer may be made less than the content of carbon atoms in the surface protective layer, the electric charges can be kept from stagnating at the interface between the upper-part charge injection blocking layer and the surface protective layer, and the cause of residual potential can be lessened. As the result, the electric charges having stayed can be kept from flowing sideways, so that difficulties such as smeared images can be kept from occurring.

The upper-part charge injection blocking layer may further preferably be incorporated with atoms capable of controlling conductivity, and may be incorporated with Group-13 atoms.

The content of Group-13 atoms in the upper-part charge injection blocking layer may be determined by overall judgement from the ability to prevent smeared EV, the ability to block the injection of electric charges and the image quality. Usually, it may preferably be 10 atomic ppm or more, more preferably 50 atomic ppm or more, and still more preferably 100 atomic ppm or more, and be preferably 10,000 atomic ppm or less, more preferably 5,000 atomic ppm or less, and still more preferably 3,000 atomic ppm or less, based on the silicon atoms.

As long as the content of Group-13 atoms is 10 atomic ppm or more, the injection of electric charges from the surface can well be blocked, and the smeared EV can also be kept from occurring. Also, as long as the content of Group-13 atoms is 10,000 atomic ppm or less, the smeared EV can also be kept from occurring, without damaging any charge injection blocking ability.

The atoms capable of controlling conductivity may include what is called impurities, used in the field of semiconductors. Of these, the Group-13 atoms are impurities capable of imparting p-type conductivity. The Group-13 atoms may specifically include boron (B), aluminum (Al), gallium (Ga), indium (In) and thallium (Tl). In particular, B, Al and Ga are preferred.

To structurally incorporate the Group-13 atoms, a source material for incorporating Group-13 atoms may be fed, when the layer is formed, into the reactor in a gaseous state together with other gases used to form the upper-part charge injection blocking layer. Those which may serve as the source material for incorporating Group-13 atoms should be those which are gaseous at normal temperature and normal pressure or at least those which are readily gasifiable under conditions for the layer formation. Such a source material for incorporating Group-13 atoms may specifically include, as a material for incorporating boron atoms, boron hydrides such as $B_2H_6$, $B_4H_{10}$, $B_5H_9$, $B_5H_{11}$, $B_6H_{12}$, $B_6H_{12}$ and $B_6H_{14}$, and boron halides such as $BF_3$, $BCl_3$ and $BBr_3$. Besides, the material may also include $AlCl_3$, $GaCl_3$, $Ga(CH_3)_3$, $InCl_3$ and $TlCl_3$.

These source materials for incorporating Group-13 atoms may optionally be diluted with gas such as $H_2$, He, Ar or Ne when used.

The upper-part charge injection blocking layer is carefully formed so that the required performances can be provided as desired. More specifically, from the structural viewpoint, the material which contains Si and C and to which H and/or X has or have optionally been added takes the form of from crystalline such as polycrystalline and microcrystalline to amorphous (generically termed as "non-single-crystal") depending on the conditions for its formation. From the viewpoint of electrical properties, it exhibits the nature of from conductive to semiconductive and up to insulating, and also the nature of from photoconductive to non-photoconductive. Accordingly, in the present invention, the conditions for its formation are severely selected as desired so that a compound having the desired properties as intended can be formed.

In order to form a upper-part charge injection blocking layer having the stated characteristics, it is necessary to appropriately set the substrate temperature, the gas pressure inside the reactor and the discharge power in accordance with the characteristics.

The temperature of the substrate may appropriately be selected within an optimum range in accordance with the designing of layer construction. The temperature may usually preferably be set in the range of from 200 to 350° C., more preferably from 230 to 330° C., and most preferably from 250 to 310° C.

The gas pressure inside the reactor may also appropriately be selected within an optimum range in accordance with the designing of layer construction. It may usually be controlled in the range of from $1\times10^{-2}$ to $2\times10^{3}$ Pa, preferably from $5\times10^{-2}$ to $5\times10^{2}$ Pa, and most preferably from $1\times10^{-1}$ to $2\times10^{2}$ Pa.

The discharge power may still also appropriately be selected within an optimum range in accordance with the designing of layer construction, where the ratio of the discharge power to the flow rate of Si-feeding gas may usually be controlled in the range of from 0.5 to 10, preferably from 0.8 to 8, and most preferably from 1 to 6.

Preferable numerical values for the above substrate temperature, gas pressure and discharge power to form the upper-part charge injection blocking layer may be within the above ranges. These conditions, however, are by no means independently separately determined in usual cases. Optimum values should be determined on the basis of mutual and systematic relationship so that the upper-part charge injection blocking layer having the desired characteristics can be formed.

The layer thickness of the upper-part charge injection blocking layer may be determined by overall judgement from the layer thickness of the photoconductive layer and surface protective layer and the required electrophotographic performances. From the viewpoint of sufficiently exhibiting the ability to block the injection of electric charges from the surface and not affecting image quality, the layer thickness may usually be so designed as to be 0.01 $\mu$m to 0.5 $\mu$m.

Surface Protective Layer

A surface protective layer of carbon-containing amorphous silicon (a-SiC) type is formed on the upper-part charge injection blocking layer. This surface protective layer has a free surface, and is provided in order to improve moisture resistance, performance on continuous repeated use, electrical breakdown strength, service environmental properties and running performance.

The surface protective layer may be formed using any materials so long as they are a-SiC materials, as exemplified by a-SiC containing hydrogen atoms (H) and/or halogen atoms (X) (herein also "a-SiC:H,X").

The surface protective layer is formed by a vacuum-deposition deposited film forming process under conditions appropriately numerically set in accordance with film-forming parameters so as to achieve the desired performances. Stated specifically, it may be formed by various thin-film deposition processes as exemplified by glow discharging (including AC discharge CVD such as low-frequency CVD, high-frequency CVD or microwave CVD, and DC discharge CVD), sputtering, vacuum metallizing, ion plating, photo-assisted CVD and thermal CVD. These thin-film deposition processes may be employed under appropriate selection according to the conditions for manufacture, the extent of a load on capital investment in equipment, the scale of manufacture and the properties and performances desired on electrophotographic photosensitive members to be produced. In view of productivity of electrophotographic photosensitive members, it is preferable to use the same deposition process as that for the photoconductive layer.

For example, to form the surface protective layer comprised of a-SiC:H,X by glow discharging, basically an Si-feeding source gas capable of feeding silicon atoms (Si), a C-feeding source gas capable of feeding carbon atoms (C), an H-feeding source gas capable of feeding hydrogen atoms (H) and an X-feeding source gas capable of feeding halogen atoms (X) may be introduced in the desired gaseous state into a reactor whose inside can be evacuated, and glow discharge may be caused to take place in the reactor so that the layer comprised of a-SiC:H,X is formed on the substrate previously set at a given position and on which the layers up to the upper-part charge injection blocking layer have been formed.

In the a-SiC as a material for the surface protective layer chief constituent, carbon atoms may preferably be in a content of from 40% to 90% based on the total of silicon atoms and carbon atoms.

The hydrogen atoms and halogen atoms contained in the surface protective layer compensate unbonded arms of constituent atoms such as silicon atoms and improve layer quality, in particular, improve photoconductivity and charge retentivity. From such a viewpoint, the hydrogen atoms, for example fluorine atoms may preferably be in a content of from 30 to 70 atomic %, more preferably from 35 to 65 atomic %, and still more preferably from 40 to 60 atomic %, based on the total amount of constituent atoms. The halogen atoms may also usually be in a content of from 0.01 to 15 atomic %, preferably from 0.1 to 10 atomic %, and more preferably from 0.6 to 4 atomic %.

The surface protective layer may preferably have a layer thickness of from 0.01 to 3 $\mu$m, more preferably from, 0.05 to 2 $\mu$m, and particularly preferably from 0.1 to 1 $\mu$m. As long as it has a layer thickness of 0.01 $\mu$m or more, a sufficient durability of the surface protective layer can be ensured. As long as it has a layer thickness of 3 $\mu$m or less, the residual potential can be kept from increasing to achieve satisfactory electrophotographic performances.

Figure 2:
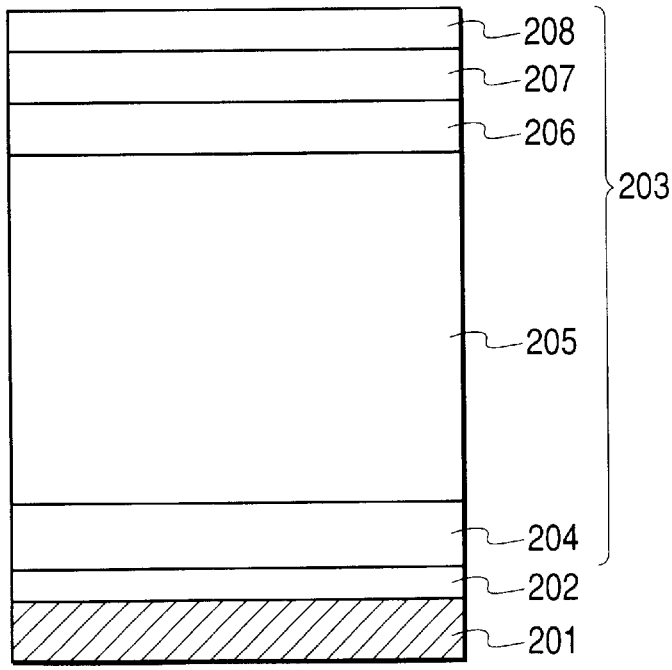
FIG. 2 is a diagrammatic sectional view illustrating another example of layer construction of the electrophotographic photosensitive member according to the present invention.

FIG. 2 shows an example of layer construction in which a non-single crystal carbon film 208 is formed as an outermost surface layer on the surface protective layer 207. Stated specifically, an amorphous carbon layer 208 containing carbon atoms chiefly (a-C:H,X) is superposed at the outermost surface on the a-SiC:H,X, surface protective layer 207.

In this instance, a light-receiving layer 203 is provided on a cylindrical aluminum substrate 201, and a silicate film 202 is formed between the cylindrical aluminum substrate 201 and the light-receiving layer 203. The light-receiving layer 203 is constituted of, in the order from the substrate side, a lower-part charge injection blocking layer 204, a photoconductive layer 205 and an upper-part charge injection blocking layer 206 and an a-SiC:H,X, surface protective layer 207 on which the amorphous carbon layer 208 containing carbon atoms chiefly (a-C:H,X) is superposed.

Here, the outermost surface layer is formed in the same manner as the surface protective layer.

For example, to form the outermost surface layer comprised of a-C:H,X by glow discharging, basically a C-feeding source gas capable of feeding carbon atoms (C), an H-feeding source gas capable of feeding hydrogen atoms (H) and an X-feeding source gas capable of feeding halogen atoms (X) may be introduced in the desired gaseous state into a reactor whose inside can be evacuated, and glow discharge may be caused to take place in the reactor so that the layer comprised of a-C:H,X is formed on the substrate previously set at a given position and on which the layers including the photoconductive layer and the surface protective layer have been formed.

The electrophotographic photosensitive member making use of a-C:H,X as the outermost surface layer has superior surface hardness, has superior running performance and can maintain high image quality even in its long-time use. It also makes ozone (generated by corona discharging) adhere hardly to the surface, and makes it possible to provide good images free of occurrence of smeared images without heating the photosensitive member in an electrophotographic apparatus. In particular, in negative-charging development processes, the quantity of ozone products produced at the time of corona charging is about 10 times that of positive-charging development processes. This has been ascertained by our experiments. Hence, it is especially effective to use a-C:H,X as the outermost surface layer.

Moreover, any peeling of deposited films can be kept from being caused by distortion or the like of the deposited films as a result of long-time use and also any minute cracks can be kept from being caused in the deposited films as a result of exposure to corona. The present inventors have discovered that such difficulties can be kept from occurring as a secondary effect obtained by combination with the silicate film provided between the substrate and the light-receiving layer.

Materials that may serve as source gases for feeding silicon atoms (Si), used to form the surface protective layer, may include gaseous or gasifiable silicon hydrides (silanes) such as $SiH_4$, $Si_2H_6$, $Si_3H_8$ and $Si_4H_{10}$, which may effectively be used. In view of readiness in handling for layer formation and Si-feeding efficiency, $SiH_4$ and $Si_2H_6$ are particularly preferred. These Si-feeding source gases may also be used optionally after their dilution with a gas such as $H_2$, He, Ar or Ne.

Materials that may serve as source gases for feeding carbon atoms (C) for the surface protective layer and the outermost surface layer may include gaseous or gasifiable hydrocarbons such as $CH_4$, $C_2H_2$, $C_2H_6$, $C_3H_8$ and $C_4H_{10}$, which may effectively be used. In view of readiness in handling for layer formation and C-feeding efficiency, $CH_4$, $C_2H_2$ and $C_2H_6$ are particularly preferred. These C-feeding source gases may be used optionally after their dilution with a gas such as $H_2$, He, Ar or Ne.

To make it more easy to control the percentage in which the hydrogen atoms are incorporated into the surface protective layer to be formed, the layer may preferably be formed using any of these gases further mixed with a desired amount of hydrogen gas or a gas of a silicon compound containing hydrogen atoms. Each gas may be mixed not only alone in a single species but also in combination of plural species in a desired mixing ratio, without any problems.

Materials effective as source gases for feeding halogen atoms may preferably include gaseous or gasifiable halogen compounds as exemplified by halogen gases, halides, halogen-containing interhalogen compounds and silane derivatives substituted with a halogen. The materials may also include gaseous or gasifiable halogen-containing silicon hydride compounds constituted of silicon atoms and halogen atoms as a mixed element, which may also be effective for the formation of the surface protective layer.

Halogen compounds that may preferably be used may specifically include fluorine gas ($F_2$) and interhalogen compounds such as BrF, ClF, $ClF_3$, $BrF_3$, $BrF_5$, $IF_3$ and $IF_7$. Silicon compounds containing halogen atoms, what is called silane derivatives substituted with halogen atoms, may specifically include silicon fluorides such as $SiF_4$ and $Si_2F_6$, which are preferable examples.

To control the quantity of the hydrogen atoms and/or halogen atoms incorporated in the surface protective layer and outermost surface layer, for example the temperature of the substrate, the quantity in which materials used to incorporate the hydrogen atoms and/or halogen atoms are introduced into a reactor, the discharge power and so forth may be controlled.

Apparatus and film-forming methods for forming the light-receiving layer is described below in detail.

Figure 4:
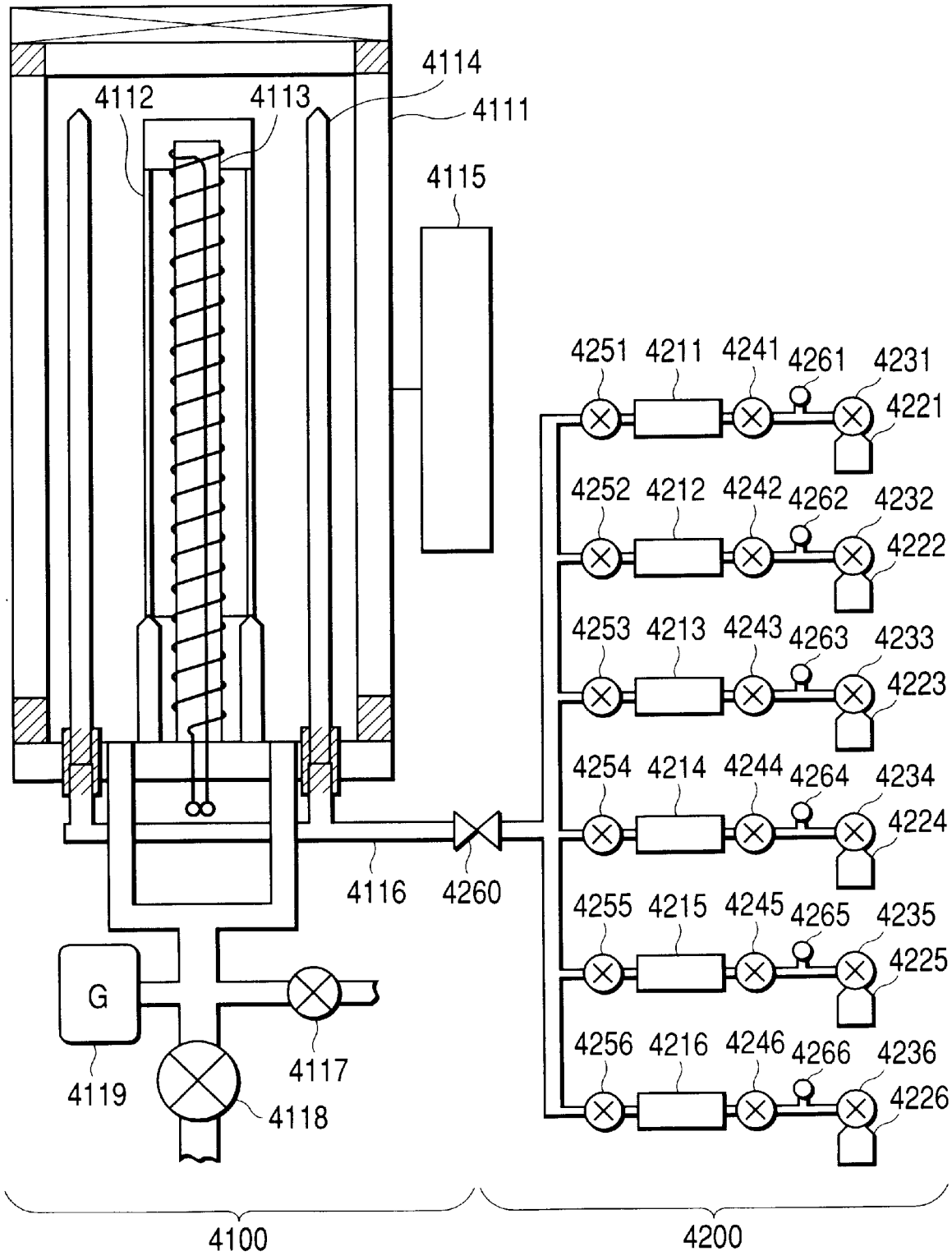
FIG. 4 is a diagrammatic sectional view illustrating a light-receiving layer formation system.

FIG. 4 diagrammatically illustrates the constitution of an example of an apparatus for producing the negative-charging electrophotographic photosensitive member by high-frequency plasma-assisted CVD making use of RF bands as power source frequency (hereinafter simply "RF-PCVD"). The production apparatus shown in FIG. 4 is constructed in the following way.

This apparatus is constituted chiefly of a deposition system 4100, a source gas feed system 4200 and an exhaust system (not shown) for evacuating the inside of a reactor 4111. In the reactor 4111 in the deposition system 4100, a cylindrical substrate 4112, a substrate heater 4113 and source gas feed pipes 4114 are provided. A high-frequency matching box 4115 is also connected to the reactor.

The source gas feed system 4200 is constituted of gas cylinders 4221 to 4226 for source gases such as $SiH_4$, $GeH_4$, $H_2$, $CH_4$, $B_2H_6$ and $PH_3$, valves 4231 to 4236, 4241 to 4246 and 4251 to 4256, pressure regulators 4261 to 4266 and mass flow controllers 4211 to 4216. The gas cylinders for the respective source gases are connected to the gas feed pipe 4114 in the reactor 4111 through a valve 4260 and a gas pipe 4116.

Using this apparatus, deposited films may be formed, e.g., in the following way.

First, the cylindrical substrate 4112 is set in the reactor 4111, and the inside of the reactor is evacuated by means of an exhaust device (e.g., a vacuum pump; not shown). Subsequently, the temperature of the cylindrical substrate 4112 is controlled at a stated temperature of, e.g., from 200° C. to 350° C. by means of the heater 4113 for heating the substrate.

Before source gases for forming deposited films are flowed into the reactor 4111, gas cylinder valves 4231 to 4236 and a leak valve 4117 of the reactor are checked to make sure that they are closed, and also flow-in valves 4241 to 4246, flow-out valves 4251 to 4256 and an auxiliary valve 4260 are checked to make sure that they are opened. Thereafter, first a main valve 4118 is opened to evacuate the insides of the reactor 4111 and a gas pipe 4116.

Next, at the time a vacuum gauge 4119 has been read to indicate a pressure of about $1\times10^{-2}$ Pa, the auxiliary valve 4260 and the flow-out valves 4251 to 4256 are closed.

Thereafter, gas cylinder valves 4231 to 4236 are opened so that gases are respectively introduced from the gas cylinders 4221 to 4226, and each gas is controlled to have a pressure of 19.6 N/cm$^2$ by operating pressure controllers 4261 to 4266. Next, the flow-in valves 4241 to 4246 are slowly opened so that gases are respectively introduced into the mass flow controllers 4211 to 4216.

After the film formation is thus ready to start, the respective layers are formed according to the following procedure.

At the time the cylindrical substrate 4112 has come to a stated temperature, some necessary valves among the flow-out valves 4251 to 4256 and the auxiliary valve 4260 are slowly opened so that stated gases are fed into the reactor 4111 from the gas cylinders 4221 to 4226 through the gas feed pipe 4114. Next, the mass flow controllers 4211 to 4216 are operated so that each source gas is adjusted to flow at a stated rate. In that course, the opening of the main valve 4118 is adjusted watching the vacuum gauge 4119 so that the pressure inside the reactor 4111 comes to be a stated pressure of not higher than $1.5\times10^2$ Pa. At the time the inner pressure has become stable, an RF power source (not shown) with a frequency of 13.56 MHz is set at the desired electric power, and an RF power is supplied to the inside of the reactor 4111 through the high-frequency matching box 4115 to cause glow discharge to take place. The source gases fed into the reactor are decomposed by the discharge energy thus produced, so that a stated deposited film is formed on the cylindrical substrate. After a film with a stated thickness has been formed, the supply of RF power is stopped, and the flow-out valves are closed to stop gases from flowing into the reactor. The formation of a deposited film is thus completed.

The like operation is repeated plural times, whereby a light-receiving layer with the desired multi-layer structure can be formed. In this case, in between the respective layers, the discharge may once completely be stopped at the time one layer has been formed as described above and, after the gas flow rates and pressure for the next layer have been set, the discharge may again be caused to take place to form the next layer. Alternatively, after one layer has been formed, a plurality of layers may continuously be formed changing the gas flow rates, pressure and high-frequency power gradually to the preset values for the next layer over a certain period of time.

Needless to say, when the respective layers are formed, the flow-out valves other than those for necessary gases are all closed. Also, in order to prevent the corresponding gases from remaining in the reactor 4111 and in the pipe extending from the flow-out valves 4251 to 4256 to the reactor 4111, the flow-out valves 4251 to 4256 are closed, the auxiliary valve 4260 is opened and then the main valve 4118 is full-opened so that the inside of the system is first evacuated to a high vacuum; this may be optionally operated.

In order to achieve uniform film formation, it is also effective to rotate the cylindrical substrate 4112 at a stated speed by means of a driving mechanism (not shown) while the films are formed.

Also needless to say, the gas species and valve operations described above are changed according to the conditions under which each layer is formed.

In the above process, the substrate temperature at the time of the formation of deposited films may preferably be set at from 200° C. to 350° C., more preferably from 230° C. to 330° C., and most preferably from 250° C. to 310° C.

Figure 6:
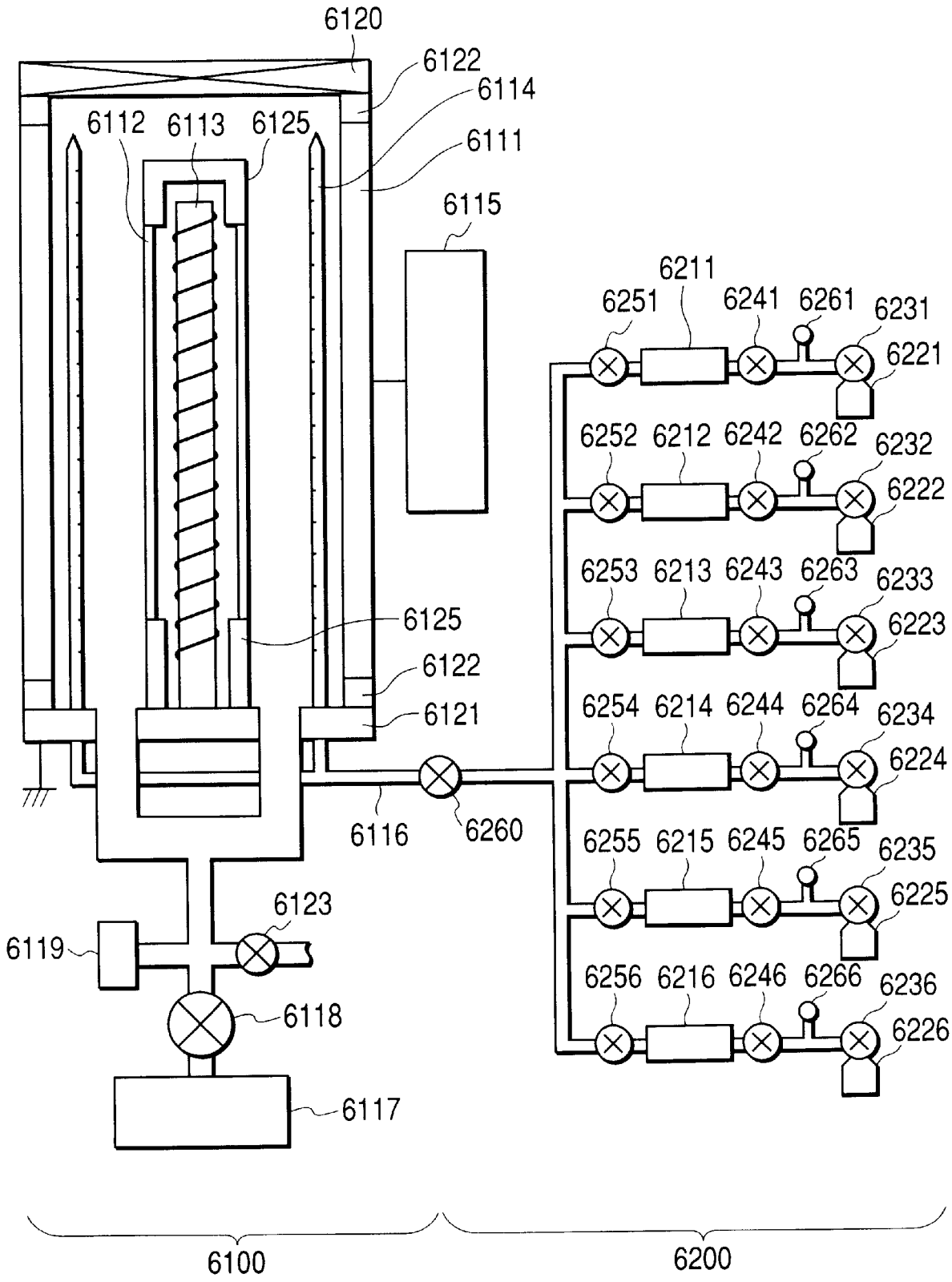
FIG. 6 is a diagrammatic sectional view illustrating a light-receiving layer formation system.

FIG. 6 diagrammatically illustrates the constitution of another example of an apparatus for producing the negative-charging electrophotographic photosensitive member by RF-PCVD. The production apparatus shown in FIG. 6 is constructed in the following way.

This apparatus is constituted chiefly of a deposition system 6100, a source gas feed system 6200 and an exhaust system 6117 for evacuating the inside of a reactor 6111. In the reactor 6111 in the deposition system 6100, a cylindrical substrate 6112, a substrate heater 6113 and source gas feed pipes 6114 are provided. A high-frequency matching box 6115 is also connected to the reactor.

The source gas feed system 6200 is constituted of gas cylinders 6221 to 6226 for source gases such as $SiH_4$, $H_2$, $CH_4$, $B_2H_6$, $PH_3$ and He, valves 6231 to 6236, 6241 to 6246 and 6251 to 6256, pressure regulators 6261 to 6266 and mass flow controllers 6211 to 6216. The gas cylinders for the respective source gases are connected to the gas feed pipe 6114 in the reactor 6111 through a valve 6260 and a gas pipe 6116.

Using this apparatus, deposited films may be formed, e.g., in the following way.

First, the cylindrical substrate 6112 is set in the reactor 6111, and the inside of the reactor is evacuated by means of an exhaust device 6117 (e.g., a vacuum pump). Subsequently, the temperature of the cylindrical substrate 6112 is controlled at a stated temperature of, e.g., from 200° C. to 350° C. by means of the heater 6113 for heating the substrate.

Before source gases for forming deposited films are flowed into the reactor 6111, gas cylinder valves 6231 to 6236 and a leak valve 6123 of the reactor are checked to make sure that they are closed, and also flow-in valves 6241 to 6246, flow-out valves 6251 to 6256 and an auxiliary valve 6260 are checked to make sure that they are opened. Thereafter, first a main valve 6118 is opened to evacuate the insides of the reactor 6111 and a gas pipe 6116.

Next, at the time a vacuum gauge 6119 has been read to indicate a pressure of about $1\times10^{-2}$ Pa, the auxiliary valve 6260 and the flow-out valves 6251 to 6256 are closed.

Thereafter, gas cylinder valves 6231 to 6236 are opened so that gases are respectively introduced from the gas cylinders 6221 to 6226, and each gas is controlled to have a pressure of 19.6 $N/cm^2$ by operating pressure controllers 6261 to 6266. Next, the flow-in valves 6241 to 6246 are slowly opened so that gases are respectively introduced into the mass flow controllers 6211 to 6216.

After the film formation is thus ready to start, the respective layers are formed according to the following procedure.

At the time the cylindrical substrate 6112 has come to a stated temperature, some necessary valves among the flow-out valves 6251 to 6256 and the auxiliary valve 6260 are slowly opened so that stated gases are fed into the reactor 6111 from the gas cylinders 6221 to 6226 through the gas feed pipe 6114. Next, the mass flow controllers 6211 to 6216 are operated so that each source gas is adjusted to flow at a stated rate. In that course, the opening of the main valve 6118 is adjusted watching the vacuum gauge 6119 so that the pressure inside the reactor 6111 comes to be a stated pressure of not higher than $1.5\times10^2$ Pa. At the time the inner pressure has become stable, an RF power source (not shown) with a frequency of 13.56 MHz is set at the desired electric power, and an RF power is supplied to the inside of the reactor 6111 through the high-frequency matching box 6115 to cause glow discharge to take place. The source gases fed into the reactor are decomposed by the discharge energy thus produced, so that a stated deposited film is formed on the cylindrical substrate. After a film with a stated thickness has been formed, the supply of RF power is stopped, and the flow-out valves are closed to stop gases from flowing into the reactor. The formation of a deposited film is thus completed.

The like operation is repeated plural times, whereby a light-receiving layer with the desired multi-layer structure can be formed. In this case, in between the respective layers, the discharge may once completely be stopped at the time one layer has been formed as described above and, after the gas flow rates and pressure for the next layer have been set, the discharge may again be caused to take place to form the next layer. Alternatively, after one layer has been formed, a plurality of layers may continuously be formed changing the gas flow rates, pressure and high-frequency power gradually to the preset values for the next layer over a certain period of time.

Needless to say, when the respective layers are formed, the flow-out valves other than those for necessary gases are all closed. Also, in order to prevent the corresponding gases from remaining in the reactor 6111 and in the pipe extending from the flow-out valves 6251 to 6256 to the reactor 6111, the flow-out valves 6251 to 6256 are closed, the auxiliary valve 6260 is opened and then the main valve 6118 is full-opened so that the inside of the system is first evacuated to a high vacuum; this may be optionally operated.

In order to achieve uniform film formation, it is also effective to rotate the cylindrical substrate 6112 at a stated speed by means of a driving mechanism (not shown) while the films are formed.

Also needless to say, the gas species and valve operations described above are changed according to the conditions under which each layer is formed.

In the above process, the substrate temperature at the time of the formation of deposited films may preferably be set at from 200° C. to 350° C., more preferably from 230° C. to 330° C., and most preferably from 250° C. to 310° C.

EXAMPLES

The present invention is specifically described below by giving Examples and Comparative Examples. The present invention is by no means limited to the following Examples. Also, unless particularly noted, commercially available high-purity products are used as reagents and so forth.

Example 1

Using the apparatus shown in FIG. 4, for producing light-receiving layers by RF-PCVD, a lower-part charge injection blocking layer, a photoconductive layer, an upper-part charge injection blocking layer and a surface protective layer were formed in this order on a mirror-finished cylindrical aluminum substrate of 80 mm in diameter under conditions shown in Table 1, to produce a negative-charging electrophotographic photosensitive member.

In this Example, before the lower-part charge injection blocking layer was formed, the surface of a cylindrical aluminum substrate was mirror-cut to obtain the above mirror-finished substrate and, on lapse of 15 minutes after the cutting was completed, the substrate surface was subjected to degreasing, silicate film formation, rinsing and drying under conditions shown in Table 2, to form a silicate film layer comprised of Al—Si—O. The electrophotographic photosensitive member produced was examined by secondary ion mass spectroscopy (SIMS) to reveal that the Al—Si—O film had atomic compositional ratio of 1:0.25:3. In this Example, besides the conditions shown in Table 2, amino alcohol and benzotriazole were further introduced in the silicate film formation step to incorporate nitrogen atoms, too. The silicate film layer thus formed was found as a result of SIMS to have a layer thickness of 8 nm and contain the nitrogen atoms in an mount of 800 atomic ppm based on the aluminum atoms.

Comparative Example 1

In this Comparative Example, the procedure of Example 1 was repeated to form the silicate film layer on the mirror-finished cylindrical aluminum substrate. Thereafter, without forming the upper-part charge injection blocking layer, the lower-part charge injection blocking layer, the photoconductive layer and the surface protective layer were formed in this order under conditions shown in Table 3, to produce a positive-charging electrophotographic photosensitive member.

Comparative Example 2

In this Comparative Example, the procedure of Example 1 was repeated to form the silicate film layer on the mirror-finished cylindrical aluminum substrate. Thereafter, without forming the upper-part charge injection blocking layer, the lower-part charge injection blocking layer, the photoconductive layer and the surface protective layer were formed in this order under conditions shown in Table 4, to produce a negative-charging electrophotographic photosensitive member.

The negative-charging electrophotographic photosensitive members and positive-charging electrophotographic photosensitive member produced in Example 1 and Comparative Examples 1 and 2 were each set in an electrophotographic apparatus (trade name: iR6000, manufactured by CANON INC.; remodeled for evaluation tests), to evaluate their characteristics. Here, the evaluation on the negative-charging electrophotographic photosensitive member was made using a like apparatus but remodeled to the negative-charging system.

Evaluation was made on three evaluation items, "chargeability", "sensitivity" and "ghost" by the following methods.

Chargeability:

The electrophotographic apparatus was set to have a process speed of 265 mm/sec. and a pre-exposure (a 660 nm wavelength LED) of 7 lux·sec, and a 655 nm wavelength semiconductor laser for image exposure was set therein. Thereafter, electric current value of its charging assembly was set at 800 $\mu$A, where the surface potential of the photosensitive member was measured with a potential sensor of a surface potentiometer (Model 344, manufactured by Trek Co.) set at the position of the developing assembly of the electrophotographic apparatus for evaluation, and the value obtained was regarded as chargeability.

Sensitivity:

Charging conditions were so set as to provide a dark-area potential of 450 V, and the amount of imagewise exposure light at the time the light-area potential came to 50 V was measured. The measured value regarded as sensitivity.

Ghost:

A ghost test chart (available from CANON INC.; parts number: FY9-9040) to which a black circle of 5 mm in diameter, having a reflection density of 1.1, was attached was placed at the image leading end of an original glass plate, and a halftone test chart (available from CANON INC.; parts number: FY9-9042) was superposingly placed thereon to make copies. In the copied images, the difference between the reflection density of the black circle of 5 mm in diameter of the ghost test chart observed on the halftone copied image and the reflection density at the halftone area was measured. Thus, the smaller the value is, the better.

As evaluation on the foregoing, the value obtained in Comparative Example 1 was regarded as 100 to make relative comparison. The results of evaluation are shown in Table 5.

The "chargeability" shows that, the larger the numerical value is, the better the charging performance is. The "sensitivity" and "ghost" show that, the smaller the numerical value is, the better.

As can be seen from the results shown in Table 5, in Example 1 the chargeability is improved compared with that in Comparative Example 1 and the ghost can be made to less occur. In respect of image characteristics, too, good image characteristics have been found to be attained.

Example 2

The procedure of Example 1 was repeated to produce a negative-charging electrophotographic photosensitive member, except that the lower-part charge injection blocking layer, the photoconductive layer, the upper-part charge injection blocking layer and the surface protective layer were formed under conditions shown in Table 6.

In Example 2, the feed rate of diborane in the upper-part charge injection blocking layer was made different to produce photosensitive members the upper-part charge injection blocking layers of which have different content (atomic ppm) of boron atoms based on silicon atoms.

The photosensitive members produced at the respective boron feed rates were evaluated on their chargeability and smeared EV.

Chargeability:

Evaluated in the same manner as in Example 1. In this Example, the chargeability of a photosensitive member having a boron content of 1,000 atomic ppm was regarded as 100 to make relative comparison. The larger the numerical value is, the better results it shows.

Smeared EV:

Using a test chart (available from CANON INC.; parts number: FY9-9058), images were formed under exposure with an intensity from 1.2 times to 1.5 times the amount of exposure at proper image density. In respect of smeared images at the time of intense exposure, evaluation was made according to the following four ranks from boundary samples prepared by visual judgement of images.

1: Very good.
2: Good.
3: No problem in practical use.
4: A little problematic in practical use.

Where it was difficult for the images to be distinctly ranked, they were ranked, e.g., as 1.5 when ranked between 1 and 2.

The results of evaluation are shown in Tables 7(A) and 7(B).

As shown in Tables 7(A) and 7(B), very good results are obtained on both the items when the content of boron atoms based on silicon atoms is in the range of preferably from 10 to 10,000 atomic ppm, more preferably from 50 to 5,000 atomic ppm, and most preferably from 100 to 3,000 atomic ppm.

Example 3

The procedure of Example 1 was repeated to produce a negative-charging electrophotographic photosensitive member, except that the lower-part charge injection blocking layer, the photoconductive layer, the upper-part charge injection blocking layer and the surface protective layer were formed under conditions shown in Table 8.

In Example 3, the flow rate of $CH_4$ in forming the upper-part charge injection blocking layer was made different to produce photosensitive members the upper-part charge injection blocking layers of which have different content (atomic %) of carbon atoms based on the sum of silicon atoms and carbon atoms in the, upper-part charge injection blocking layer.

The content of carbon atoms was measured by SIMS of the photosensitive member.

The photosensitive members produced under the respective conditions were evaluated on their chargeability and smeared EV in the same manner as in Example 2.

The results of evaluation are shown in Table 9.

As shown in Table 9, very good results are obtained on both the items as long as the content of carbon atoms is in the range of from 10 atomic % to 70 atomic %.

Example 4

The procedure of Example 1 was repeated to produce negative-charging electrophotographic photosensitive members, except that, in this Example, the gas flow rate of nitrogen monoxide (NO) used in forming the lower-part charge injection blocking layer was made different. The photosensitive members thus produced were examined by SIMS to reveal that in each lower-part charge injection blocking layer the total content of nitrogen atoms and oxygen atoms based on the silicon atoms was 0.05 atomic %, 0.1 atomic %, 1.2 atomic %, 10 atomic %, 20 atomic %, 40 atomic % or 45 atomic %.

Comparative Example 3

The procedure of Example 1 was repeated to produce a negative-charging electrophotographic photosensitive members, except that, in this Comparative Example, the nitrogen monoxide was not used as the source gase in forming the lower-part charge injection blocking layer and instead oxygen gas ($O_2$) diluted with helium gas was used to incorporate oxygen atoms in the lower-part charge injection blocking layer in a content of 6 atomic % based on the silicon atoms.

Comparative Example 4

The procedure of Example 1 was repeated to produce a negative-charging electrophotographic photosensitive members, except that, in this Comparative Example, the nitrogen monoxide was not used as the source gase in forming the lower-part charge injection blocking layer and instead ammonia gas (NH3) was used to incorporate nitrogen atoms in the lower-part charge injection blocking layer in a content of 4 atomic % based on the silicon atoms.

Comparative Example 5

The procedure of Example 1 was repeated to produce a negative-charging electrophotographic photosensitive members, except that, in this Comparative Example, the lower-part charge injection blocking layer was not formed.

The negative-charging electrophotographic photosensitive members produced in Example 4 and Comparative Examples 3 to 5 were evaluated in the same manner as in Example 1 on the three evaluation items, "chargeability", "sensitivity" and "ghost".

The results of evaluation are shown in Tables 10(A) and 10(B). In Tables 10(A) and 10(B), the results are shown by relative comparison, regarding as 100 the value obtained when the photosensitive member was produced in Comparative Example 5.

As can be seen from Tables 10(A) and 10(B), in Example 4 the formation of the silicate film on the cylindrical aluminum substrate and the incorporation of oxygen atoms and nitrogen atoms in the lower-part charge injection blocking layer in a total content ranging from 0.1 atomic % to 40 atomic % based on the silicon atoms bring about a dramatic improvement in chargeability, compared with Comparative Examples 3 to 5, and give good results also on the sensitivity and the ghost. In respect of image characteristics, too, good image characteristics have been found to be attained.

Example 5

The procedure of Example 1 was repeated to produce negative-charging electrophotographic photosensitive members, except that, in this Example, the treatment time in the silicate film formation step was made different to form silicate films having different layer thickness as shown in Table 12 and thereafter the negative-charging electrophotographic photosensitive members were produced under the conditions shown in Table 1.

Comparative Example 6

The procedure of Example 1 was repeated to produce a negative-charging electrophotographic photosensitive member, except that the substrate surface was subjected to degreasing wash, rinsing and drying under conditions shown in Table 11, without using any potassium silicate as the inhibitor and without forming any silicate film.

The photosensitive members thus produced under the respective conditions were evaluated in the same manner as in Example 1 on "chargeability", "sensitivity" and "ghost".

The results of evaluation are shown in Table 12. In Table 12, the results are shown by relative comparison, regarding as 100 the characteristics obtained in Comparative Example 6. The "chargeability" shows that, the larger the numerical value is, the better the charging performance is. The "sensitivity" and "ghost" show that, the smaller the numerical value is, the better.

As can be seen from Table 12, the formation of the silicate film in a layer thickness of from 0.5 nm to 15 nm on the cylindrical substrate brings about an improvement in chargeability, compared with Comparative Example 6, and can make the ghost less occur. In respect of image characteristics, too, good image characteristics have been found to be attained.

Example 6

A photosensitive member produced in the same manner as in Example 1 was mounted to a digital full-color copying machine (trade name: CLC500; manufactured by CANON INC.) and full-color images were formed, where very good images were obtained.

Example 7

The procedure of Example 1 was repeated to produce a negative-charging electrophotographic photosensitive member, except that an a-C:H outermost surface layer was further superposed under conditions shown in Table 13.

Comparative Example 7

A negative-charging electrophotographic photosensitive member not provided with any silicate film was produced under the same conditions as in Comparative Example 6, except that an a-C:H outermost surface layer was further superposed under the conditions shown in Table 13.

The photosensitive members produced in Example 7, the photosensitive member produced in Comparative Example 7 and a photosensitive member produced under the same conditions as in Example 1 were evaluated on their adherence by the following evaluation method. Results obtained are shown in Table 14.

Heat Shock Test:

The electrophotographic photosensitive members produced were left for 12 hours in a container regulated to a temperature of −50° C. and immediately thereafter left for 2 hours in a container regulated to a temperature of 80° C. and a humidity of 80%. This cycle was repeated by 10 cycles, and thereafter the surfaces of the electrophotographic photosensitive members were observed to make evaluation according to the following criteria.

AA: Very good.

A: Good.

B: Slight film peeling is partly seen.

C: Relatively great film peeling is partly seen.

Observation of Edge Peeling:

The edge regions (50 mm each from the upper and lower ends) of each electrophotographic photosensitive member produced were observed with a magnifier to make evaluation according to the following criteria.

AA: Very good.

A: Good.

B: Slight film peeling is partly seen.

C: Relatively great film peeling is partly seen.

Very good results are obtained in the photosensitive member of Example 7 on both the heat shock test and the observation of edge peeling.

Example 8

On a mirror-finished aluminum cylinder (substrate) of 80 mm in diameter, a silicate film was formed using the apparatus shown in FIG. 3, under conditions shown in Table 16. Then, using the apparatus shown in FIG. 6, for producing photosensitive members by RF-PCVD, a lower-part charge injection blocking layer, a first photoconductive layer, a second photoconductive layer and a surface protective layer were formed thereon in this order under conditions shown in Table 15, to produce a negative-charging electrophotographic photosensitive member. Here, in the first photoconductive layer, the content of Group-15 atoms based on silicon atoms was set to be 2 atomic ppm, and, in the second photoconductive layer, the content of Group-13 atoms based on silicon atoms was so made different as to be 0 atomic ppm, 0.01 atomic ppm, 2 atomic ppm, 7 atomic ppm and 15 atomic ppm.

The second photoconductive layer was formed in a layer thickness of 9 $\mu$m, capable of absorbing 90% or more of imagewise exposure light of 655 nm in wavelength.

As the source gas for feeding Group-15 atoms to be incorporated in the first photoconductive layer, phosphine ($PH_3$) was used. As the source gas for feeding Group-13 atoms to be incorporated in the second photoconductive layer, diborane ($B_2H_6$) was used.

Nitrogen atoms and oxygen atoms incorporated in the lower-part charge injection blocking layer were in a total content of 10 atomic % based on silicon atoms, and, as the source gas for feeding them, nitrogen monoxide (NO) gas was used.

The silicate film was formed by subjecting the aluminum substrate surface to the steps of degreasing wash, silicate film formation, rinsing and drying under conditions shown in Table 16. Also, the silicate film thus formed had atomic compositional ratio of aluminum:silicon:oxygen=1:0.25:3. Besides the conditions shown in Table 16, amino alcohol and benzotriazole were further introduced in the silicate film formation step to incorporate nitrogen atoms, too. The silicate film layer thus formed was found to have a layer thickness of 8 nm and contain the nitrogen atoms in an amount of 800 atomic ppm based on the aluminum atoms.

Comparative Example 8

The procedure of Example 8 was repeated to produce a negative-charging electrophotographic photosensitive member, except that, in this Comparative Example, in the second photoconductive layer the Group-13 atoms were incorporated in a content of 18 atomic ppm based on silicon atoms.

Comparative Example 9

The procedure of Example 8 was repeated to produce a negative-charging electrophotographic photosensitive member, except that a lower-part charge injection blocking layer, a photoconductive layer and a surface protective layer were formed on a mirror-finished aluminum cylinder (substrate) of 80 mm in diameter under conditions shown in Table 17.

In this Comparative Example, the photoconductive layer was formed in single layer and any atoms capable of controlling conductivity were not added. Also, any silicate film was not formed on the aluminum substrate.

The negative-charging electrophotographic photosensitive members thus produced in Example 8 and Comparative Examples 8 and 9 were also each set in an electrophotographic apparatus (trade name: iR6000, manufactured by CANON INC.; remodeled for evaluation tests into a negative-charging system, i.e., the image exposure method in which image areas are exposed), to evaluate their characteristics. Evaluation was made on three evaluation items, "chargeability", "sensitivity" and "photo-memory" by the following methods.

The negative-charging electrophotographic photosensitive members produced in Example 8 and Comparative Examples 8 and 9 were also each mounted to a digital full-color copying machine (trade name: CLC500; manufactured by CANON INC.), and evaluation was made on "ghost images" as image evaluation.

In regard to image quality, images were visually judged to prepare boundary samples sorted in three ranks of '(A): ghost is little seen', '(B): ghost is slightly seen' and '(C): intolerable in practical use', according to which the evaluation was made.

Chargeability:

The electrophotographic apparatus was set to have a process speed of 265 mm/sec. and a pre-exposure (a 660 nm wavelength LED) of 7 lux·sec, and a 655 nm wavelength semiconductor laser for image exposure was set therein. Thereafter, electric current value of its charging assembly was set at 800 $\mu$A, where the surface potential of the photosensitive member was measured with a potential sensor of a surface potentiometer (Model 344, manufactured by Trek Co.) set at the position of the developing assembly of the electrophotographic apparatus for evaluation, and the value obtained was regarded as chargeability. Thus, the greater the value of chargeability is, the better.

Sensitivity:

Charging conditions were so set as to provide a dark-area potential of 450 V, and the amount of imagewise exposure light at the time the light-area potential came to 50 V was measured. The measured value regarded as sensitivity. Thus, the smaller the value of sensitivity is, the better.

Photo-memory:

As memory potential, the difference between surface potential in an imagewise unexposed state and potential at the time of charging made again after imagewise exposure was made first was measured with a like potential sensor under the above conditions. Thus, the smaller the value of photo-memory is, the better.

The results of the above evaluation are shown in Table 18. In Table 18, the results are shown by relative comparison, regarding as 100 the characteristics obtained in Comparative Example 9.

As can be seen from the results shown in Table 18, in Example 8 the formation of the silicate film on the aluminum substrate, the construction thereon of the lower-part charge injection blocking layer incorporated with nitrogen atoms and oxygen atoms and the first photoconductive layer incorporated with Group-15 atoms and further the incorporation of Group-13 atoms in the second photoconductive layer in a content ranging from 0 atomic ppm to 15 atomic ppm bring about an improvement in chargeability and sensitivity and can make the photo-memory less occur, compared with Comparative Example 8. Also, in Example 8; characteristics are seen to have especially been improved in all the chargeability, the sensitivity and the lessening of photo-memory when the content of the Group-13 atoms incorporated in the second photoconductive layer is in the range of from 0.01 atomic ppm to 7 atomic ppm.

As also shown in Table 18, as a result of the image evaluation, any ghost was not seen when the content of the Group-13 atoms incorporated in the second photoconductive layer is in the range of from 0 atomic ppm to 15 atomic ppm. However, the ghost was slightly seen when it is 18 atomic ppm.

Example 9

On a mirror-finished aluminum cylinder (substrate) of 80 mm in diameter, a silicate film was formed as detailed later. Then, using the apparatus shown in FIG. 6, for producing photosensitive members by RF-PCVD, a lower-part charge injection blocking layer, a first photoconductive layer, a second photoconductive layer and a surface protective layer were formed thereon in this order under conditions shown in Table 19, to produce a negative-charging electrophotographic photosensitive member. Here, in the second photoconductive layer, the content of Group-13 atoms based on silicon atoms was set to be 1 atomic ppm, and, in the first photoconductive layer, the content of Group-15 atoms based on silicon atoms was so made different as to be 0.01 atomic ppm, 0.05 atomic ppm, 1 atomic ppm, 5 atomic ppm and 10 atomic ppm.

The second photoconductive layer was formed in a layer thickness of 7 $\mu$m, capable of absorbing 90% or more of imagewise exposure light of 655 nm in wavelength.

As the source gas for feeding Group-15 atoms to be incorporated in the first photoconductive layer, phosphine ($PH_3$) was used. As the source gas for feeding Group-13 atoms to be incorporated in the second photoconductive layer, diborane ($B_2H_6$) was used. Also, nitrogen atoms and oxygen atoms incorporated in the lower-part charge injection blocking layer were in a total content of 8 atomic % based on silicon atoms, and, as the source gas for feeding them, nitrogen monoxide (NO) was used.

In this Example, the silicate film was formed by subjecting the aluminum substrate surface to the steps of degreasing wash, silicate film formation, rinsing and drying under the conditions shown in Table 16. Also, the silicate film thus formed had atomic compositional ratio of aluminum:silicon:oxygen=1:0.25:3. Besides the conditions shown in Table 16, amino alcohol and benzotriazole were further introduced in the silicate film formation step to incorporate nitrogen atoms, too. The silicate film layer thus formed was found to have a layer thickness of 8 nm and contain the nitrogen atoms in an amount of 800 atomic ppm based on the aluminum atoms.

Comparative Example 10

The procedure of Example 9 was repeated to form the silicate film layer on the mirror-finished aluminum cylinder (substrate). Then, the lower-part charge injection blocking layer, the first and second photoconductive layers and the surface protective layer were formed thereon in this order under the conditions shown in Table 19, to produce a negative-charging electrophotographic photosensitive member, provided that, in this Comparative Example, in the first photoconductive layer the Group-15 atoms were incorporated in a content of 0 atomic ppm or 13 atomic ppm based on silicon atoms.

The photosensitive members thus produced in Example 9 and Comparative Example 10 were evaluated in the same manner as in Example 8 on the three items, "chargeability", "sensitivity" and "photo-memory". Evaluation was also made on "ghost images" as image evaluation.

The results of evaluation are shown in Table 20. In Table 20, the results are shown by relative comparison, regarding as 100 the value obtained when the photosensitive member was produced in Comparative Example 9.

As can be seen from the results shown in Table 20, in Example 9 the formation of the silicate film on the aluminum substrate, the construction thereon of the lower-part charge injection blocking layer incorporated with nitrogen atoms and oxygen atoms and the second photoconductive layer incorporated with Group-13 atoms and further the incorporation of Group-15 atoms in the first photoconductive layer in a content ranging from 0.01 atomic ppm to 10 atomic ppm bring about an improvement in chargeability and sensitivity and can make the photo-memory less occur, compared with Comparative Example 10. Also, in Example 9, characteristics are seen to have especially been improved in all the chargeability, the sensitivity and the lessening of photo-memory when the Group-15 atoms incorporated in the first photoconductive layer are in a content of from 0.05 atomic ppm to 5 atomic ppm.

As also shown in Table 20, as a result of the image evaluation, any ghost was not seen as long as the content of the Group-15 atoms incorporated in the first photoconductive layer is in the range of from 0.01 atomic ppm to 10 atomic ppm. However, the ghost was slightly seen when it is 0 atomic ppm and 13 atomic ppm.

Example 10

On a mirror-finished aluminum cylinder (substrate) of 80 mm in diameter, a silicate film was formed as detailed later. Then, using the apparatus shown in FIG. 6, for producing photosensitive members by RF-PCVD, a lower-part charge injection blocking layer, a first photoconductive layer, a second photoconductive layer and a surface protective layer were formed thereon in this order under conditions shown in Table 21, to produce a negative-charging electrophotographic photosensitive member. Here, in source gases for the lower-part charge injection blocking layer, nitrogen monoxide (NO) used, and the total content of nitrogen atoms and oxygen atoms based on the silicon atoms was so made different as to be 0.1 atomic %, 1.2 atomic %, 10 atomic %, 20 atomic % and 40 atomic %.

In the second photoconductive layer, the content of Group-13 atoms based on silicon atoms was set to be 3 atomic ppm, and, in the first photoconductive layer, the content of Group-15 atoms based on silicon atoms, 0.05 atomic ppm.

The second photoconductive layer was formed in a layer thickness of 7 $\mu$m, capable of absorbing 90% or more of imagewise exposure light of 655 nm in wavelength.

As the source gas for feeding Group-15 atoms to be incorporated in the first photoconductive layer, phosphine ($PH_3$) was used. As the source gas for feeding Group-13 atoms to be incorporated in the second photoconductive layer, diborane ($B_2H_6$) was used.

The silicate film was formed by subjecting the aluminum substrate surface to the steps of degreasing wash, silicate film formation, rinsing and drying under conditions shown in Table 22. Also, the silicate film thus formed had atomic compositional ratio of aluminum:silicon:oxygen=1:0.25:3. Besides the conditions shown in Table 22, amino alcohol and benzotriazole were further introduced in the silicate film formation step to incorporate nitrogen atoms, too. The silicate film layer thus formed was found to have a layer thickness of 11 nm and contain the nitrogen atoms in an amount of 1,300 atomic ppm based on the aluminum atoms.

Comparative Example 11

The procedure of Example 10 was repeated to form the silicate film layer on the mirror-finished aluminum cylinder (substrate) of 80 mm in diameter under the conditions shown in Table 22. Then, using the apparatus shown in FIG. 6, for producing photosensitive members by RF-PCVD, the lower-part charge injection blocking layer, the first and second photoconductive layers and the surface protective layer were formed thereon in this order under the conditions shown in Table 21, to produce a negative-charging electrophotographic photosensitive member, provided that, in this Comparative Example, in the lower-part charge injection blocking layer the total content of nitrogen atoms and oxygen atoms based on silicon atoms was set to be 0.05 atomic % or 45 atomic t.

Comparative Example 12

The procedure of Example 10 was repeated to form the silicate film layer on the mirror-finished aluminum cylinder (substrate) of 80 mm in diameter under the conditions shown in Table 22. Then, using the apparatus shown in FIG. 6, for producing photosensitive members by RF-PCVD, the lower-part charge injection blocking layer, the first and second photoconductive layers and the surface protective layer were formed thereon in this order under the conditions shown in Table 21, to produce a negative-charging electrophotographic photosensitive member, provided that, in this Comparative Example, the nitrogen monoxide was not used as a source gas in forming the lower-part charge injection blocking layer and instead oxygen gas (02) diluted with helium gas was used to incorporate oxygen atoms in the lower-part charge injection blocking layer in a content of 6 atomic % based on the silicon atoms.

Comparative Example 13

The procedure of Example 10 was repeated to form the silicate film layer on the mirror-finished aluminum cylinder (substrate) of 80 mm in diameter under the conditions shown in Table 22. Then, the lower-part charge injection blocking layer, the first and second photoconductive layers and the surface protective layer were formed thereon in this order under the conditions shown in Table 21, to produce a negative-charging electrophotographic photosensitive member, provided that, in this Comparative Example, the nitrogen monoxide was not used as a source gas in forming the lower-part charge injection blocking layer and instead ammonia gas ($NH_3$) was used to incorporate nitrogen atoms in the lower-part charge injection blocking layer in a content of 4 atomic % based on the silicon atoms.

Comparative Example 14

The procedure of Example 10 was repeated to form the silicate film layer on the mirror-finished aluminum cylinder (substrate) of 80 mm in diameter under the conditions shown in Table 22. Then, the first and second photoconductive layers and the surface protective layer were formed thereon in this order under the conditions shown in Table 21, to produce a negative-charging electrophotographic photosensitive member, provided that, in this Comparative Example, the lower-part charge injection blocking layer was not formed.

The photosensitive members thus produced in Example 10 and Comparative Examples 11 to 14 were evaluated in the same manner as in Example 8 on the three items, "chargeability", "sensitivity" and "photo-memory". Evaluation was also made on "ghost images" as image evaluation.

The results of evaluation are shown in Tables 23(A) and 23(B). In Tables 23(A) and 23(B), the results are shown by relative comparison, regarding as 100 the value obtained when the photosensitive member was produced in Comparative Example 14.

As can be seen from the results shown in Tables 23(A) and 23(B), in Example 10 the formation of the silicate film on the aluminum substrate, the incorporation of Group-15 atoms in the first photoconductive layer, the incorporation of Group-13 atoms in the second photoconductive layer and the construction of the lower-part charge injection blocking layer incorporated with nitrogen atoms and oxygen atoms in a total content of from 0.1 atomic % to 40 atomic % based on silicon atoms bring about a dramatic improvement in chargeability, compared with Comparative Examples 12 to 14, and bring about good results also on sensitivity and photo-memory.

As also can be seen from comparison of Example 10 with Comparative Example 11, good results are obtained especially on the chargeability when the nitrogen atoms and oxygen atoms are incorporated in a total content of from 1.2 atomic % to 20 atomic % based on silicon atoms.

As also shown in Tables 23(A) and 23(B), as a result of the image evaluation, any ghost was not seen when the nitrogen atoms and oxygen atoms are incorporated in a total content of from 0.1 atomic % to 40 atomic % based on silicon atoms.

Example 11

On a mirror-finished aluminum cylinder (substrate) of 80 mm in diameter, a silicate film was formed under conditions shown in Table 25. Thereafter, using the apparatus shown in FIG. 6, for producing photosensitive members by RF-PCVD, a lower-part charge injection blocking layer, a first photoconductive layer, a second photoconductive layer and a surface protective layer were formed thereon in this order under conditions shown in Table 25, to produce a negative-charging electrophotographic photosensitive member. Here, the silicate film was formed regulating temperature and treatment time as shown in Table 25, to form the film in a layer thickness made different to be 0.5 nm, 5 nm, 10 nm and 15 nm. The silicate film thus formed had atomic compositional ratio of aluminum:silicon:oxygen=1:0.25:3. Besides the conditions shown in Table 25, amino alcohol and benzotriazole were further introduced in the silicate film formation step to incorporate nitrogen atoms in a content of 1,300 atomic ppm based on the aluminum atoms.

Nitrogen atoms and oxygen atoms were incorporated in the lower-part charge injection blocking layer in a total content of 12 atomic % based on silicon atoms, using, as the source gas for feeding them, nitrogen monoxide (NO).

In the second photoconductive layer, the content of Group-13 atoms based on silicon atoms was set to be 4 atomic ppm, and, in the first photoconductive layer, the content of Group-15 atoms based on silicon atoms, 1 atomic ppm.

As the source gas for feeding Group-15 atoms to be incorporated in the first photoconductive layer, phosphine ($PH_3$) was used. As the source gas for feeding Group-13 atoms to be incorporated in the second photoconductive layer, diborane ($B_2H_6$) was used.

The second photoconductive layer was formed in a layer thickness of 7 $\mu$m, capable of absorbing 90% or more of imagewise exposure light of 655 nm in wavelength.

Comparative Example 15

The procedure of Example 11 was repeated to form the silicate film layer on the mirror-finished aluminum cylinder (substrate) of 80 mm in diameter under the conditions shown in Table 25. Then, the lower-part charge injection blocking layer, the first and second photoconductive layers and the surface protective layer were formed thereon in this order under the conditions shown in Table 24, to produce a negative-charging electrophotographic photosensitive member, provided that, in this Comparative Example, the silicate film on the aluminum substrate was formed in a thickness of 0.3 nm or 16 nm.

Comparative Example 16

The procedure of Example 11 was repeated to form on a mirror-finished aluminum cylinder (substrate) of 80 mm in diameter the lower-part charge injection blocking layer, the first and second photoconductive layers and the surface protective layer in this order under the conditions shown in Table 24, to produce a negative-charging electrophotographic photosensitive member.

In this Comparative Example, any silicate film was not formed on the aluminum substrate.

The negative-charging electrophotographic photosensitive members thus produced in Example 11 and Comparative Examples 15 and 16 were evaluated in the same manner as in Example 8 on the three items, "chargeability", "sensitivity" and "photo-memory". Evaluation was also made on "ghost images" as image evaluation.

The results of evaluation are shown in Table 26. In Table 26, the results are shown by relative comparison, regarding as 100 the value obtained when the photosensitive member was produced in Comparative Example 16.

As can be seen from the results shown in Table 26, in Example 11 the formation of the silicate film on the aluminum substrate in a layer thickness ranging from 0.5 nm to 15 nm, the incorporation of Group-15 atoms in the first photoconductive layer, the incorporation of Group-13 atoms in the second photoconductive layer and the construction of the lower-part charge injection blocking layer incorporated with nitrogen atoms and oxygen atoms bring about an improvement in chargeability, compared with Comparative Examples 15 and 16, and bring out good results also on sensitivity and photo-memory.

As also shown in Table 26, as a result of the image evaluation, any ghost was not seen when the silicate film is in a layer thickness ranging from 0.5 nm to 15 nm.

As having been described above, according to the present invention, the negative-charging electrophotographic photosensitive member constituted of a non-single crystal material comprising silicon atoms as a matrix can be obtained which can be improved in chargeability and sensitivity and can make photo-memory less occur, both at high levels, and hence can dramatically be improved in image quality, and also which can maintain image quality even when used for a long time and used in severe environment.

TABLE 1

| | Lower-part charge injection blocking layer | Photo-conductive layer | Upper-part charge injection blocking layer | Surface protective layer |
|---|---|---|---|---|
| Gas species & flow rates: [ml/min (normal)] | | | | |
| $SiH_4$ | 100 | 100 | 100 | 10 |
| $H_2$ | 500 | 800 | — | — |
| NO | 10 | — | — | — |
| $CH_4$ | — | — | 300 | 400 |
| $B_2H_6$* | — | — | 300 | |
| Pressure: (Pa) | 64 | 79 | 60 | 60 |
| RF power: (W) | 100 | 300 | 300 | 100 |
| Layer thickness: ($\mu$m) | 2.5 | 30 | 0.5 | 0.5 |

*ppm (based on $SiH_4$)

TABLE 2

| | Wash chamber | | | |
|---|---|---|---|---|
| | 1 | 2 | 3 | 4 |
| Treating steps: | Degreasing wash | Film formation | Rinsing | Hot-water draw-up drying |
| Treating agent: | Nonionic surfactant | Pure water | Pure water | Pure water |
| Temperature: | 40° C. | 25° C. | 25° C. | 45° C. |
| Concentration: | 5% | 0.4% | — | |
| Treating time: | 3 min. | 2 min. | 1 min. | 1 min. |
| Inhibitor: | — | Potassium silicate | — | — |
| Others: | Ultrasonic treatment | Ultrasonic treatment | — | — |

TABLE 3

| | Lower-part charge injection blocking layer | Photo-conduc-tive layer | Surface protective layer |
|---|---|---|---|
| Gas species & flow rates: [ml/min (normal)] | | | |
| $SiH_4$ | 100 | 100 | 10 |
| $H_2$ | 500 | 800 | — |
| NO | 10 | — | — |
| $CH_4$ | — | — | 400 |
| $B_2H_6$* | 3,000 | — | — |
| Pressure: (Pa) | 64 | 79 | 60 |
| RF power: (W) | 100 | 300 | 100 |
| Layer thickness: ($\mu$m) | 2.5 | 30 | 0.5 |

*ppm (based on $SiH_4$)

TABLE 4

| | Lower-part charge injection blocking layer | Photo-conduc-tive layer | Surface protective layer |
|---|---|---|---|
| Gas species & flow rates: [ml/min (normal)] | | | |
| $SiH_4$ | 100 | 100 | 10 |
| $H_2$ | 500 | 800 | — |
| NO | 10 | — | — |
| $CH_4$ | — | — | 400 |
| $B_2H_6$* | — | — | — |
| Pressure: (Pa) | 64 | 79 | 60 |
| RF power: (W) | 100 | 300 | 100 |
| Layer thickness: ($\mu$m) | 2.5 | 30 | 0.5 |

*ppm (based on $SiH_4$)]

TABLE 5

| | Example | Comparative Example | |
|---|---|---|---|
| | 1 | 2 | 1 |
| Chargeability: | 120 | 80 | 100 |
| Sensitivity: | 80 | 90 | 100 |
| Ghost: | 70 | 90 | 100 |

TABLE 6

| | Lower-part charge injection blocking layer | Photo-conduc-tive layer | Upper-part charge injection blocking layer | Surface protective layer |
|---|---|---|---|---|
| Gas species & flow rates [ml/min (normal)] | | | | |
| $SiH_4$ | 100 | 100 | 100 | 10 |
| $H_2$ | 500 | 800 | — | — |
| NO | 10 | — | — | — |

TABLE 6-continued

| | Lower-part charge injection blocking layer | Photo-conduc-tive layer | Upper-part charge injection blocking layer | Surface protective layer |
|---|---|---|---|---|
| $CH_4$ | — | — | 300 | 400 |
| $B_2H_6$* | — | — | *1 | — |
| Pressure: (Pa) | 64 | 79 | 60 | 60 |
| RF power: (W) | 100 | 300 | 300 | 100 |
| Layer thickness: ($\mu$m) | 2.5 | 30 | 0.5 | 0.5 |

*ppm (based on $SiH_4$)]

*1: flow rate changed

TABLE 7(A)

| Boron content: (atomic ppm) | 5 | 10 | 50 | 100 | 1,000 |
|---|---|---|---|---|---|
| Chargeability: | 80 | 95 | 100 | 100 | 100 |
| Smeared EV: (1.2 times) | 2 | 1.5 | 1 | 1 | 1 |
| Smeared EV: (1.5 times) | 3 | 2 | 1.5 | 1 | 1 |

TABLE 7(B)

| Boron content: (atomic ppm) | 3,000 | 5,000 | 10,000 | 11,000 |
|---|---|---|---|---|
| chargeability: | 105 | 110 | 110 | 110 |
| Smeared EV: (1.2 times) | 1 | 1 | 1.5 | 2 |
| Smeared EV: (1.5 times) | 1 | 1.5 | 2 | 3 |

TABLE 8

| | Lower-part charge injection blocking layer | Photo-conduc-tive layer | Upper-part charge injection blocking layer | Surface protective layer |
|---|---|---|---|---|
| Gas species & flow rates: [ml/min (normal)] | | | | |
| $SiH_4$ | 100 | 100 | 100 | 10 |
| $H_2$ | 500 | 800 | — | — |
| NO | 10 | — | — | — |
| $CH_4$ | — | — | *1 | 400 |
| $B_2H_6$* | — | — | 300 | — |
| Pressure: (Pa) | 64 | 79 | 60 | 60 |
| RF power: (W) | 100 | 300 | 300 | 100 |
| Layer thickness: ($\mu$m) | 2.5 | 30 | 0.5 | 0.5 |

*ppm (based on $SiH_4$)]

*1: flow rate changed

TABLE 9

| Carbon content: C/(Si—C) (atomic %) | 5 | 10 | 30 | 50 | 70 | 75 |
|---|---|---|---|---|---|---|
| Chargeability: | 80 | 100 | 100 | 100 | 105 | 106 |
| Smeared EV: (1.2 times) | 1 | 1 | 1 | 1 | 1 | 1.5 |
| Smeared EV: (1.5 times) | 1 | 1 | 1 | 1 | 1 | 2 |

TABLE 10(A)

| | Example 4 (atomic %) | | | | | | |
|---|---|---|---|---|---|---|---|
| | 0.05 | 0.1 | 1.2 | 10 | 20 | 40 | 45 |
| Chargeability: | 155 | 165 | 170 | 175 | 173 | 168 | 155 |
| Sensitivity: | 69 | 63 | 61 | 60 | 62 | 62 | 68 |
| Ghost: | 77 | 61 | 50 | 51 | 50 | 62 | 75 |

TABLE 10(B)

| | Comparative Example | | |
|---|---|---|---|
| | 3 | 4 | 5 |
| Chargeability: | 110 | 108 | 100 |
| Sensitivity: | 95 | 94 | 100 |
| Ghost: | 96 | 95 | 100 |

TABLE 11

| Treating steps: | Degreasing wash | Rinsing | Hot-water draw-up drying |
|---|---|---|---|
| Treating agent: | Nonionic surfactant | Pure water | Pure water |
| Temperature: | 40° C. | 25° C. | 45° C. |
| Concentration: | 5% | — | — |
| Treating time: | 5 min. | 1 min. | 1 min. |
| Others: | Ultrasonic treatment | — | — |

TABLE 12

| Silicate film layer thickness: | Example 5 | | | | | Comparative Example 6 |
|---|---|---|---|---|---|---|
| (nm) | 0.5 | 1 | 5 | 10 | 15 | — |
| Chargeability: | 125 | 130 | 135 | 135 | 130 | 100 |
| Sensitivity: | 80 | 85 | 80 | 75 | 75 | 100 |
| Ghost: | 75 | 75 | 70 | 70 | 70 | 100 |

TABLE 13

| Gas species & flow rates: [ml/min (normal)] | a-C:H Outermost surface layer |
|---|---|
| $CH_4$ | 100 |
| $H_2$ | 100 |
| Pressure: (Pa) | 60 |
| RF power: (W) | 1,000 |
| Layer thickness: ($\mu$m) | 0.3 |

TABLE 14

| | Example 7 | Example 1 | Comparative Example 7 |
|---|---|---|---|
| Silicate film: | yes | yes | no |
| Surface layer: | a-C | a-SiC | a-C |
| Heat shock test: | AA | A | A |
| Edge peeling: | AA | AA | A |

TABLE 15

| | Lower-part charge injection blocking layer | First photo-conduc-tive layer | Second photo-conduc-tive layer | Surface protective layer |
|---|---|---|---|---|
| Gas species & flow rates: $SiH_4$ [ml/min (normal)] | 100 | 100 | 100 | 10 |
| $H_2$ [ml/min (normal)] | 600 | 800 | 800 | — |
| Content of Group-13 atoms based on silicon atoms: (atomic ppm) | — | — | 0~15 | — |
| Content of Group-15 atoms based on silicon atoms: (atomic ppm) | — | 2 | — | — |
| Sum of nitrogen atoms and oxygen atoms based on silicon atoms: (atomic %) | 10 | — | — | — |
| $CH_4$ [ml/min (normal)] | — | — | — | 400 |
| Substrate temperature: (° C.) | 260 | 260 | 260 | 260 |
| Pressure: (Pa) | 64 | 79 | 79 | 60 |
| RF power: (W) | 100 | 300 | 300 | 200 |
| Layer thickness: ($\mu$m) | 2.5 | 23 | 9 | 0.5 |

TABLE 16

| | Wash chamber | | | |
|---|---|---|---|---|
| | 1 | 2 | 3 | 4 |
| Treating steps: | Degreasing wash | Film formation | Rinsing | Drying |
| Treating agent: | Nonionic surfactant | Aqueous potassium silicate solution | Pure water | Pure water |
| Temperature: | 40° C. | 27° C. | 25° C. | 45° C. |
| Concentration: | 5% | 0.4% | — | — |
| Treating time: | 180 sec. | 120 sec. | 150 sec. | 150 sec. |
| Others: | Ultrasonic treatment | Ultrasonic treatment | — | — |

TABLE 17

| | Lower-part charge injection blocking layer | Photo-conduc-tive layer | Surface protective layer |
|---|---|---|---|
| Gas species & flow rates: $SiH_4$ [ml/min (normal)] | 100 | 100 | 10 |
| $H_2$ [ml/min (normal)] | 600 | 800 | — |

TABLE 17-continued

| | Lower-part charge injection blocking layer | Photo-conductive layer | Surface protective layer |
|---|---|---|---|
| Content of Group-13 atoms based on silicon atoms: (atomic ppm) | — | — | — |
| Content of Group-15 atoms based on silicon atoms: (atomic ppm) | — | — | — |
| Sum of nitrogen atoms and oxygen atoms based on silicon atoms: (atomic %) | 10 | — | — |
| $CH_4$ [ml/min (normal)] | — | — | 400 |
| Substrate temperature: (° C.) | 260 | 260 | 260 |
| Pressure: (Pa) | 64 | 79 | 60 |
| RF power: (W) | 100 | 300 | 200 |
| Layer thickness: (μm) | 2.5 | 32 | 0.5 |

TABLE 18

| | Example 8 (atomic ppm) | | | | | | Comparative Example | |
|---|---|---|---|---|---|---|---|---|
| | 0 | 0.01 | 2 | 7 | 15 | 18 | 8 | 9 |
| Chargeability: | 144 | 149 | 152 | 148 | 139 | 110 | 100 | |
| Sensitivity: | 89 | 83 | 81 | 82 | 92 | 95 | 100 | |
| Photo-memory: | 86 | 83 | 84 | 84 | 91 | 97 | 100 | |
| Ghost images: | A | A | A | A | A | B | C | |

TABLE 19

| | Lower-part charge injection blocking layer | First photo-conductive layer | Second photo-conductive layer | Surface protective layer |
|---|---|---|---|---|
| Gas species & flow rates: $SiH_4$ [ml/min (normal)] | 100 | 100 | 200 | 10 |
| $H_2$ [ml/min (normal)] | 600 | 800 | 800 | — |
| Content of Group-13 atoms based on silicon atoms: (atomic ppm) | — | — | 1 | — |
| Content of Group-15 atoms based on silicon atoms: (atomic ppm) | — | 0.01~10 | — | — |
| Sum of nitrogen atoms and oxygen atoms based on silicon atoms: (atomic %) | 8 | — | — | — |
| $CH_4$ [ml/min (normal)] | — | — | — | 400 |
| Substrate temperature: (° C.) | 260 | 260 | 260 | 260 |
| Pressure: (Pa) | 64 | 79 | 79 | 60 |
| RF power: (W) | 100 | 300 | 600 | 200 |
| Layer thickness: (μm) | 2.5 | 25 | 7 | 0.5 |

TABLE 20

| | Example 9 (atomic ppm) | | | | | | Comparative Example | |
|---|---|---|---|---|---|---|---|---|
| | 0.01 | 0.05 | 1 | 5 | 10 | 0 | 13 | |
| Chargeability: | 142 | 147 | 150 | 144 | 140 | 137 | 138 | 100 |
| Sensitivity: | 85 | 78 | 80 | 79 | 89 | 91 | 94 | 100 |
| Photo-memory: | 83 | 81 | 82 | 83 | 88 | 92 | 93 | 100 |
| Ghost image: | A | A | A | A | A | B | B | C |

TABLE 21

| | Lower-part charge injection blocking layer | First photo-conductive layer | Second photo-conductive layer | Surface protective layer |
|---|---|---|---|---|
| Gas species & flow rates: $SiH_4$ [ml/min (normal)] | 100 | 200 | 200 | 10 |
| $H_2$ [ml/min (normal)] | 600 | 800 | 800 | — |
| Content of Group-13 atoms based on silicon atoms: (atomic ppm) | — | — | 3 | — |
| Content of Group-15 atoms based on silicon atoms: (atomic ppm) | — | 0.05 | — | — |
| Sum of nitrogen atoms and oxygen atoms based on silicon atoms: (atomic %) | 0.1~40 | — | — | — |
| $CH_4$ [ml/min (normal)] | — | — | — | 400 |
| Substrate temperature: (° C.) | 260 | 260 | 260 | 260 |
| Pressure: (Pa) | 64 | 79 | 79 | 60 |
| RF power: (W) | 100 | 600 | 600 | 200 |
| Layer thickness: (μm) | 2.5 | 25 | 7 | 0.5 |

TABLE 22

| | Wash chamber | | | |
|---|---|---|---|---|
| | 1 | 2 | 3 | 4 |
| Treating steps: | Degreasing wash | Film formation | Rinsing | Drying |
| Treating agent: | Nonionic surfactant | Aqueous potassium silicate solution | Pure water | Pure water |
| Temperature: | 40° C. | 29° C. | 25° C. | 45° C. |
| Concentration: | 5% | 0.4% | — | — |
| Treating time: | 180 sec. | 140 sec. | 150 sec. | 150 sec. |
| Others: | Ultrasonic treatment | Ultrasonic treatment | — | — |

TABLE 23(A)

| | Example 10 | | | | | Comparative Example 11 | |
|---|---|---|---|---|---|---|---|
| | (atomic %) | | | | | | |
| | 0.1 | 1.2 | 10 | 20 | 40 | 0.05 | 45 |
| Chargeability: | 140 | 150 | 154 | 156 | 149 | 122 | 145 |
| Sensitivity: | 79 | 76 | 78 | 77 | 80 | 88 | 92 |
| Photo-memory: | 78 | 74 | 75 | 74 | 79 | 86 | 89 |
| Ghost images: | A | A | A | A | A | B | B |

TABLE 23(B)

| | Comparative Example | | |
|---|---|---|---|
| | 12 | 13 | 14 |
| Chargeability: | 110 | 106 | 100 |
| Sensitivity: | 95 | 94 | 100 |
| Photo-memory: | 96 | 95 | 100 |
| Ghost images: | C | C | C |

TABLE 24

| | Lower-part charge injection blocking layer | First photo-conduc-tive layer | Second photo-conduc-tive layer | Surface protective layer |
|---|---|---|---|---|
| Gas species & flow rates: $SiH_4$ [ml/min (normal)] | 150 | 150 | 150 | 10 |
| $H_2$ [ml/min (normal)] | 600 | 800 | 800 | — |
| Content of Group-13 atoms based on silicon atoms: (atomic ppm) | — | — | 4 | — |
| Content of Group-15 atoms based on silicon atoms: (atomic ppm) | — | 1 | — | — |
| Sum of nitrogen atoms and oxygen atoms based on silicon atoms: (atomic %) | 12 | — | — | — |
| $CH_4$ [ml/min (normal)] | — | — | — | 400 |
| Substrate temperature: (° C.) | 260 | 260 | 260 | 260 |
| Pressure: (Pa) | 64 | 79 | 79 | 60 |
| RF power: (W) | 200 | 450 | 450 | 200 |
| Layer thickness: (μm) | 2.5 | 25 | 7 | 0.5 |

TABLE 25

| | Wash chamber | | | |
|---|---|---|---|---|
| | 1 | 2 | 3 | 4 |
| Treating steps: | Degreasing wash | Film formation | Rinsing | Drying |
| Treating agent: | Nonionic surfactant | Aqueous potassium silicate solution | Pure water | Pure water |
| Temperature: | 40° C. | 25~30° C. | 25° C. | 45° C. |
| Concentration: | 5% | 0.4% | — | — |

TABLE 25-continued

| | Wash chamber | | | |
|---|---|---|---|---|
| | 1 | 2 | 3 | 4 |
| Treating time: | 180 sec. | 80~200 sec. | 150 sec. | 150 sec. |
| Others: | Ultrasonic treatment | Ultrasonic treatment | — | — |

TABLE 26

| | Example 11 | | | | | Comparative Example 15 | 16 |
|---|---|---|---|---|---|---|---|
| | 0.5 nm | 5 nm | 10 nm | 15 nm | 0.3 nm | 16 nm | |
| Chargeability: | 130 | 139 | 138 | 133 | 119 | 122 | 100 |
| Sensitivity: | 89 | 86 | 87 | 89 | 93 | 95 | 100 |
| Photo-memory: | 88 | 87 | 88 | 88 | 95 | 93 | 100 |
| Ghost images: | A | A | A | A | B | B | C |

What is claimed is:

1. A negative-charging electrophotographic photosensitive member comprising an aluminum or aluminum alloy substrate and at least a film and a light-receiving layer which are superposed in this order from the substrate, wherein;

said film has a layer thickness of from 0.5 nm to 15 nm, comprises aluminum atoms, silicon atoms and oxygen atoms, and contains the silicon atoms in an amount of from 0.1 atomic part to 1 atomic part and the oxygen atoms in an amount of from 1 atomic part to 5 atomic parts both based on 1 atomic part of the aluminum atoms; and said light-receiving layer has at least a lower-part charge injection blocking layer formed of a non-single crystal silicon film comprising at least silicon atoms, nitrogen atoms and oxygen atoms, not doped with any impurities; a photoconductive layer formed of a non-single crystal silicon film comprising at least silicon atoms; an upper-part charge injection blocking layer formed of a non-signal crystal silicon film comprising at least silicon atoms, carbon atoms and atoms belonging to the Group 13 of the periodic table; and a surface protective layer formed of a non-single crystal silicon film comprising at least silicon atoms and carbon atoms, which layers are superposed in this order from the substrate.

2. The negative-charging electrophotographic photosensitive member according to claim 1, wherein said film is formed using water containing an inhibitor.

3. The negative-charging electrophotographic photosensitive member according to claim 2, wherein said inhibitor is a silicate.

4. The negative-charging electrophotographic photosensitive member according to claim 1, wherein said film contains nitrogen atoms in an amount of from 1 atomic ppm to 10 atomic % based on the aluminum atoms.

5. The negative-charging electrophotographic photosensitive member according to claim 1, wherein a non-single crystal carbon film is provided on said surface protective layer.

6. The negative-charging electrophotographic photosensitive member according to claim 1, wherein, in said upper-part charge injection blocking layer, said atoms belonging to the Group 13 of the periodic table are boron atoms, and the boron atoms are in a content of from 10 atomic ppm to 10,000 atomic ppm based on the silicon atoms.

7. The negative-charging electrophotographic photosensitive member according to claim 1, wherein, in said upper-part charge injection blocking layer, the carbon atoms are in a content ranging from 10 atomic % to 70 atomic % based on the sum of silicon atoms and carbon atoms, and are less than the content of carbon atoms in said surface protective layer.

8. The negative-charging electrophotographic photosensitive member according to claim 1, wherein the total sum of nitrogen atoms and oxygen atoms incorporated in said lower-part charge injection blocking layer is from 0.1 atomic % to 40 atomic % based on the silicon atoms.

9. A negative-charging electrophotographic photosensitive member comprising an aluminum or aluminum alloy substrate and at least a film and a light-receiving layer which are superposed in this order from the substrate, wherein;

said film has a layer thickness of from 0.5 nm to 15 nm, comprises at least aluminum atoms, silicon atoms and oxygen atoms, and contains the silicon atoms in an amount of from 0.1 atomic part to 1 atomic part and the oxygen atoms in an amount of from 1 atomic part to 5 atomic parts both based on 1 atomic part of the aluminum atoms; and said light-receiving layer has at least a lower-part charge injection blocking layer and a photoconductive layer having a first photoconductive layer and a second photoconductive layer which are superposed in this order from the substrate;

said lower-part charge injection blocking layer being formed of a non-single crystal silicon film comprising at least silicon atoms, nitrogen atoms, oxygen atoms, and one of hydrogen atoms and halogen atoms, not doped with any impurities;

said photoconductive layer being formed of a non-single crystal silicon film comprising at least silicon atoms and one of hydrogen atoms and halogen atoms;

said first photoconductive layer containing atoms belonging to the Group 15 of the periodic table in an amount of from 0.01 atomic ppm to 10 atomic ppm based on the silicon atoms; and said second photoconductive layer not containing any atoms belonging to the Group 13 of the periodic table.

10. The negative-charging electrophotographic photosensitive member according to claim 9, wherein, in said lower-part charge injection blocking layer, the total sum of nitrogen atoms and oxygen atoms is in an amount of from 0.1 atomic % to 40 atomic % based on the silicon atoms.

11. The negative-charging electrophotographic photosensitive member according to claim 9, wherein said film is formed using water containing an inhibitor.

12. The negative-charging electrophotographic photosensitive member according to claim 11, wherein said inhibitor is a silicate.

13. The negative-charging electrophotographic photosensitive member according to claim 9, wherein said film contains nitrogen atoms in an amount of from 1 atomic ppm to 10 atomic % based on the aluminum atoms.

14. The negative-charging electrophotographic photosensitive member according to claim 9, wherein said second photoconductive layer has a layer thickness which enables absorption of 90% or more of peak-wavelength light of imagewise exposure.

15. The negative-charging electrophotographic photosensitive member according to claim 9, wherein said second photoconductive layer has a layer thickness which enables absorption of 90% or more of light with wavelengths of from 650 nm to 700 nm.

16. A negative-charging electrophotographic photosensitive member comprising an aluminum or aluminum alloy substrate and at least a film and a light-receiving layer which are superposed in this order from the substrate, wherein;

said film has a layer thickness of from 0.5 nm to 15 nm, comprises at least aluminum atoms, silicon atoms and oxygen atoms, and contains the silicon atoms in an amount of from 0.1 atomic part to 1 atomic part and the oxygen atoms in an amount of from 1 atomic part to 5 atomic parts both based on 1 atomic part of the aluminum atoms; and said light-receiving layer has at least a lower-part charge injection blocking layer and a photoconductive layer having a first photoconductive layer and a second photoconductive layer which are superposed in this order from the substrate;

said lower-part charge injection blocking layer being formed of a non-single crystal silicon film comprising at least silicon atoms, nitrogen atoms, oxygen atoms, and one of hydrogen atoms and halogen atoms, not doped with any impurities;

said photoconductive layer being formed of a non-single crystal silicon film comprising at least silicon atoms and one of hydrogen atoms and halogen atoms, said first photoconductive layer containing atoms belonging to the Group 15 of the periodic table in an amount of from 0.01 atomic ppm to 10 atomic ppm based on the silicon atoms; and said second photoconductive layer containing atoms belonging to the Group 13 of the periodic table in an amount of 15 atomic ppm or less.

17. The negative-charging electrophotographic photosensitive member according to claim 16, wherein, in said lower-part charge injection blocking layer, the total sum of nitrogen atoms and oxygen atoms is in an amount of from 0.1 atomic % to 40 atomic % based on the silicon atoms.

18. The negative-charging electrophotographic photosensitive member according to claim 16, wherein said film is formed using water containing an inhibitor.

19. The negative-charging electrophotographic photosensitive member according to claim 18, wherein said inhibitor is a silicate.

20. The negative-charging electrophotographic photosensitive member according to claim 16, wherein said film contains nitrogen atoms in an amount of from 1 atomic ppm to 10 atomic % based on the aluminum atoms.

21. The negative-charging electrophotographic photosensitive member according to claim 16, wherein said second photoconductive layer has a layer thickness which enables absorption of 90% or more of peak-wavelength light of imagewise exposure.

22. The negative-charging electrophotographic photosensitive member according to claim 16, wherein said second photoconductive layer has a layer thickness which enables absorption of 90% or more of light with wavelengths of from 650 nm to 700 nm.

23. The negative-charging electrophotographic photosensitive member according to claim 9, wherein said light-receiving layer has a surface protective layer.

24. The negative-charging electrophotographic photosensitive member according to claim 16, wherein said light-receiving layer has a surface protective layer.

* * * * *

UNITED STATES PATENT AND TRADEMARK OFFICE

CERTIFICATE OF CORRECTION

PATENT NO. : 6,635,397 B2
DATED : October 21, 2003
INVENTOR(S) : Ryuji Okamura et al.

It is certified that error appears in the above-identified patent and that said Letters Patent is hereby corrected as shown below:

Title page,
Item [30], Foreign Application Priority Data, "2001 - 109395" should read -- 2002 - 109395 --.

Column 19,
Line 54, "$B_5H_{11}$, $B_6H_{12}$," should read -- $B_5H_{11}$, $B_6H_{10}$. --.

Column 35,
Line 45, "atomic t." should read -- atomic % --.

Column 42,
Table 15, "

| | | | | |
|---|---|---|---|---|
| Gas species & flow rates: | 100 | 100 | 100 | 10 |
| $SiH_4$ [ml/mm (normal)] | | | | |

should read --

| | | | | | |
|---|---|---|---|---|---|
| Gas species & flow rates: | | | | | |
| $SiH_4$ [ml/mm (normal)] | | 100 | 100 | 100 | 10 |

--

Table 17, "

| | | | |
|---|---|---|---|
| Gas species & flow rates: | 100 | 100 | 100 |
| $SiH_4$ [ml/mm (normal)] | | | |

should read --

| | | | |
|---|---|---|---|
| Gas species & flow rates: | | | |
| $SiH_4$ [ml/mm (normal)] | 100 | 100 | 100 |

--

UNITED STATES PATENT AND TRADEMARK OFFICE

CERTIFICATE OF CORRECTION

PATENT NO. : 6,635,397 B2
DATED : October 21, 2003
INVENTOR(S) : Ryuji Okamura et al.

It is certified that error appears in the above-identified patent and that said Letters Patent is hereby corrected as shown below:

Column 43,
Table 19, "

| | | | | |
|---|---|---|---|---|
| Gas species & flow rates: | 100 | 100 | 200 | 10 |
| $SiH_4$ [ml/mm (normal)] | | | | |

should read --

| | | | | |
|---|---|---|---|---|
| Gas species & flow rates: | | | | |
| $SiH_4$ [ml/mm (normal)] | 100 | 100 | 200 | 10 |

--

Column 44,
Table 21, "

| | | | | |
|---|---|---|---|---|
| Gas species & flow rates: | 100 | 200 | 200 | 10 |
| $SiH_4$ [ml/mm (normal)] | | | | |

should read --

| | | | | |
|---|---|---|---|---|
| Gas species & flow rates: | | | | |
| $SiH_4$ [ml/mm (normal)] | 100 | 200 | 200 | 10 |

--

Column 45,
Table 24, "

| | | | | |
|---|---|---|---|---|
| Gas species & flow rates: | 150 | 150 | 150 | 10 |
| $SiH_4$ [ml/mm (normal)] | | | | |

should read --

| | | | | |
|---|---|---|---|---|
| Gas species & flow rates: | | | | |
| $SiH_4$ [ml/mm (normal)] | 150 | 150 | 150 | 10 |

--

UNITED STATES PATENT AND TRADEMARK OFFICE

CERTIFICATE OF CORRECTION

PATENT NO. : 6,635,397 B2
DATED : October 21, 2003
INVENTOR(S) : Ryuji Okamura et al.

It is certified that error appears in the above-identified patent and that said Letters Patent is hereby corrected as shown below:

Column 45,
Table 15, "

| | Comparative Example 15 | 16 |
|---|---|---|
| 0.3 nm | 16 nm | |
| 119 | 122 | 100 |
| 93 | 95 | 100 |
| 95 | 93 | 100 |
| B | B | C |

should read --

| | Comparative Example 15 | 16 |
|---|---|---|
| 0.3 nm | 16 nm | |
| 119 | 122 | 100 |
| 93 | 95 | 100 |
| 95 | 93 | 100 |
| B | B | C |

--;

Line 42, "non-signal" should read -- non-single --.

Signed and Sealed this

Fifth Day of October, 2004

JON W. DUDAS
*Director of the United States Patent and Trademark Office*